US008783682B2

(12) United States Patent
Iijima

(10) Patent No.: US 8,783,682 B2
(45) Date of Patent: Jul. 22, 2014

(54) IMAGE RECORDING APPARATUS

(71) Applicant: Brother Kogyo Kabushiki Kaisha, Nagoya-shi (JP)

(72) Inventor: Shota Iijima, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/037,781

(22) Filed: Sep. 26, 2013

(65) Prior Publication Data

US 2014/0167346 A1 Jun. 19, 2014

(30) Foreign Application Priority Data

Dec. 13, 2012 (JP) ..... 2012-272795

(51) Int. Cl.
*B65H 5/00* (2006.01)

(52) U.S. Cl.
USPC ..... 271/225; 271/185; 271/264; 271/265.02; 271/902

(58) Field of Classification Search
USPC ..... 271/185, 186, 225, 264, 265.01, 271/265.02, 265.03, 902
See application file for complete search history.

(56) References Cited

U.S. PATENT DOCUMENTS 6,043,901 A 3/2000 Isozaki
7,946,578 B2 * 5/2011 Hatayama et al. ..... 271/186
8,152,161 B2 * 4/2012 Samoto et al. ..... 271/186
2011/0309564 A1 12/2011 Samoto et al.
2012/0161382 A1 * 6/2012 Morinaga et al. ..... 271/10.01
2013/0256983 A1 * 10/2013 Horade et al. ..... 271/225
2013/0278664 A1 * 10/2013 Arakane et al. ..... 347/16

FOREIGN PATENT DOCUMENTS

JP H02-171262 A 7/1990
JP H10-336359 A 12/1998
JP 2004-123313 A 4/2004
JP 2012-001332 A 1/2012

* cited by examiner

*Primary Examiner* — Stefanos Karmis
*Assistant Examiner* — Howard Sanders
(74) *Attorney, Agent, or Firm* — Merchant & Gould P.C.

(57) ABSTRACT

There is provided an image recording apparatus including: a main body with first and second transporting paths, a transporting roller pair, a recording portion, a reversal roller pair, a re-transporting roller pair, a transporting motor, first and second transmission mechanisms, and a controller. The second transmission mechanism has: a sun gear, an arm, a pendulum gear, and a gear row. The second transmission mechanism is configured to change a posture between a first posture and a second posture. The controller is configured to determine a position of the sheet, determine a size of the sheet, switch the rotation of the transporting motor under certain conditions, and increase the rotation amount of the transporting motor more for the case that the size of the sheet is determined to be not less than a transport distance than for the case that it is determined to be less than the transport distance.

9 Claims, 11 Drawing Sheets

Fig. 8

| Switch gear 51 | First position | | Second position | |
|---|---|---|---|---|
| Transporting motor 71 | Normal driving | Reverse driving | Normal driving | Reverse driving |
| Driving force transmission mechanism 50 | Third state | Fourth state | Second state | First state |
| First transporting roller 60 | Normal rotation | Reverse rotation | Normal rotation | Reverse rotation |
| Second transporting roller 62 | Normal rotation (First driving force transmission portion 26) | Non-transmission | Normal rotation (First driving force transmission portion 26) | Reverse rotation (Second driving force transmission portion 27) |
| Third transporting roller 45 | Normal rotation (Third driving force transmission portion 33) | Non-transmission | Normal rotation (Third driving force transmission portion 33) | Reverse rotation (Third driving force transmission portion 33) |
| Fourth transporting roller 68 | Non-transmission | Non-transmission | Normal rotation (Fourth driving force transmission portion 28) | Reverse rotation (Fourth driving force transmission portion 28) |
| Feeding roller 25 | Non-transmission | Normal rotation (Feed driving force transmission portion 29) | Non-transmission | Non-transmission |

IMAGE RECORDING APPARATUS

CROSS REFERENCE TO RELATED APPLICATION

The present application claims priority from Japanese Patent Application No. 2012-272795, filed on Dec. 13, 2012, the disclosure of which is incorporated herein by reference in its entirety.

BACKGROUND OF THE INVENTION

1. Field of the Invention

The present invention relates to image recording apparatuses capable of carrying out image recording on both sides of a sheet.

2. Description of the Related Art

There are known image recording apparatuses configured to perform image recording on both sides of a sheet. More specifically, such an image recording apparatus includes: a transporting roller pair which transports the sheet on a first transporting path in a first transporting orientation toward a recording portion; a reversal roller pair which either transports the sheet, on a surface of which images have been recorded by the recording portion, in the first transporting orientation, or reverses the sheet to transport the sheet into a second transporting path; and a re-transporting roller pair which transports the sheet on the second transporting path in a second transporting orientation toward the transporting roller pair.

In view of the requirement of small size and low cost for image recording apparatuses in recent years, it is preferable to mount a small number of motors in an image recording apparatus. Hence, the transporting roller pair and reversal roller pair are configured to rotate positively or normally in an orientation to transport the sheet in the first transporting orientation when the motor is caused to rotate in one orientation, whereas the transporting roller pair and reversal roller pair are configured to rotate negatively or reversely when the motor is caused to rotate in the other orientation. On the other hand, using a pendulum gear mechanism, the re-transporting roller pair is configured to rotate normally in an orientation to transport the sheet in the second transporting orientation whether the motor is caused to rotate in the one orientation or in the other orientation.

SUMMARY OF THE INVENTION

In the image recording apparatus of the above configuration, when an attempt is made to reverse a large-size sheet in the second transporting path, then it is possible to give rise to pulling at the sheet against each other between the transporting roller pair and the reversal roller pair. Further, the pendulum gear mechanism needs a certain amount of time to switch itself after the motor is caused to reverse the rotary orientation. Therefore, during the time of switching the rotation of the motor, the driving force becomes temporarily not transmittable to the re-transporting roller pair.

As a result, when the rotation of the motor is switched with both the transporting roller pair and the reversal roller pair sandwiching the sheet to be reversed, then due to pulling at the sheet against each other between the transporting roller pair and the reversal roller pair, it is possible to cause slippage in the transporting roller pair. This slippage may contribute to the occurrence of nonuniformity or variation in the anterior end position of the sheet, in a head-out operation or an edge-alignment operation to cause the anterior end of the sheet to reach a recording start position.

The present invention is made in view of the above situation, and an object thereof is to provide an image recording apparatus capable of appropriately carrying out the edge-alignment operation for the reversed sheet.

According to an aspect of the present invention, there is provided an image recording apparatus configured to record images on a sheet for recording, the apparatus including:

a main body including a first transporting path and a second transporting path formed therein, the first transporting path being a path through which the sheet is transported in a first transporting orientation, and the second transporting path being a path which branches from the first transporting path at a branch position and rejoins the first transporting path at a junction position on the upstream side to the branch position in the first transporting orientation and through which the sheet is transported in a second transporting orientation from the branch position toward the junction position;

a transporting roller pair provided at the first transporting path on the downstream side from the junction position in the first transporting orientation, and configured to rotate in a normal rotation to transport the sheet on the first transporting path in the first transporting orientation and to rotate in a reverse rotation in the opposite orientation to the normal rotation;

a recording portion provided at the first transporting path on the downstream side from the transporting roller pair in the first transporting orientation and on the upstream side to the branch position in the first transporting orientation to carry out image recording on the sheet transported by the transporting roller pair;

a reversal roller pair provided at the first transporting path on the downstream side from the branch position in the first transporting orientation, and configured to rotate in a normal rotation to transport the sheet with the images recorded by the recording portion in the first transporting orientation and to rotate in a reverse rotation to transport the upstream end of the sheet as the anterior end in the first transporting orientation to the second transporting path;

a re-transporting roller pair provided at the second transporting path, and configured to rotate in a normal rotation to transport the sheet, transported to the second transporting path by the reversal roller pair, in the second transporting orientation;

a transporting motor configured to rotate in a normal rotation and a reverse rotation;

a first transmission mechanism configured to transmit one of the normal rotation and the reverse rotation of the transporting motor to the transporting roller pair and the reversal roller pair to rotate normally, and configured to transmit the other of the normal rotation and reverse rotation of the transporting motor to the transporting roller pair and the reversal roller pair to rotate reversely;

a second transmission mechanism configured to transmit the rotations of the transporting motor to the re-transporting roller pair to rotate normally; and a controller, wherein the second transmission mechanism includes: a sun gear configured to rotate in a first orientation by the normal rotation of the transporting motor, and to rotate in a second orientation opposite to the first orientation by the reverse rotation of the transporting motor; an arm supported to be revolvable relative to the sun gear; a pendulum gear rotatably supported by the arm to engage the sun gear, configured to revolve around the sun gear in the first orientation by the rotation of the sun gear in the first orientation, and to revolve around the sun gear in the second orientation by the rotation of the sun gear in the second orientation; and a gear row including a plurality of gears engaging each other to transmit the rotation of the sun gear to a driving axle of the re-transporting roller pair by engaging the pendulum gear which has revolved in the first orientation and in the second orientation, wherein the second transmission mechanism is configured to change posture between a first posture and a second posture, the first posture being a posture to transmit the rotation of the sun gear in the first orientation to the driving axle with the pendulum gear and an odd number of gears included in the gear row, and the second posture being a posture to transmit the rotation of the sun gear in the second orientation to the driving axle with the pendulum gear and an even number of gears included in the gear row, wherein the controller is configured to perform:

determining a position of the sheet;

determining a size of the sheet;

switching the rotation of the transporting motor from one to the other between the normal rotation and the reverse rotation under a condition that it is determined that the sheet having passed through the second transporting path has reached the transporting roller pair; and increasing the rotation amount of the transporting motor more for the case that the size of the sheet is determined to be not less than a transport distance from the reversal roller pair to the transporting roller pair than for the case that it is determined to be less than the transport distance, in an edge-alignment operation to cause the anterior end of the sheet to reach a print starting position facing the recording portion.

According to the above configuration, the rotation amount of the transporting motor is increased, that is, the transportation amount of the transporting motor is increased in the edge-alignment operation, when the reversed sheet is sandwiched by the transporting roller pair and by the reversal roller pair. As a result, it is possible to suppress the variation in the head-out position caused by pulling at the sheet against each other between the transporting roller pair and the reversal roller pair.

According to the present invention, because the rotation amount of the transporting motor is changed according to whether or not the reversed sheet is sandwiched by the transporting roller pair and by the reversal roller pair, it is possible to attain an image recording apparatus capable of appropriately carrying out the edge-alignment operation for the reversed sheet.

BRIEF DESCRIPTION OF THE DRAWINGS

FIG. 8 is a table for explaining orientations of rotating a sheet of recording paper 12 with a feed roller 25 and respective transporting rollers 60, 62, 45 and 68 relative to the position of the switch gear 51;

DESCRIPTION OF THE PREFERRED EMBODIMENT

Figure 1:
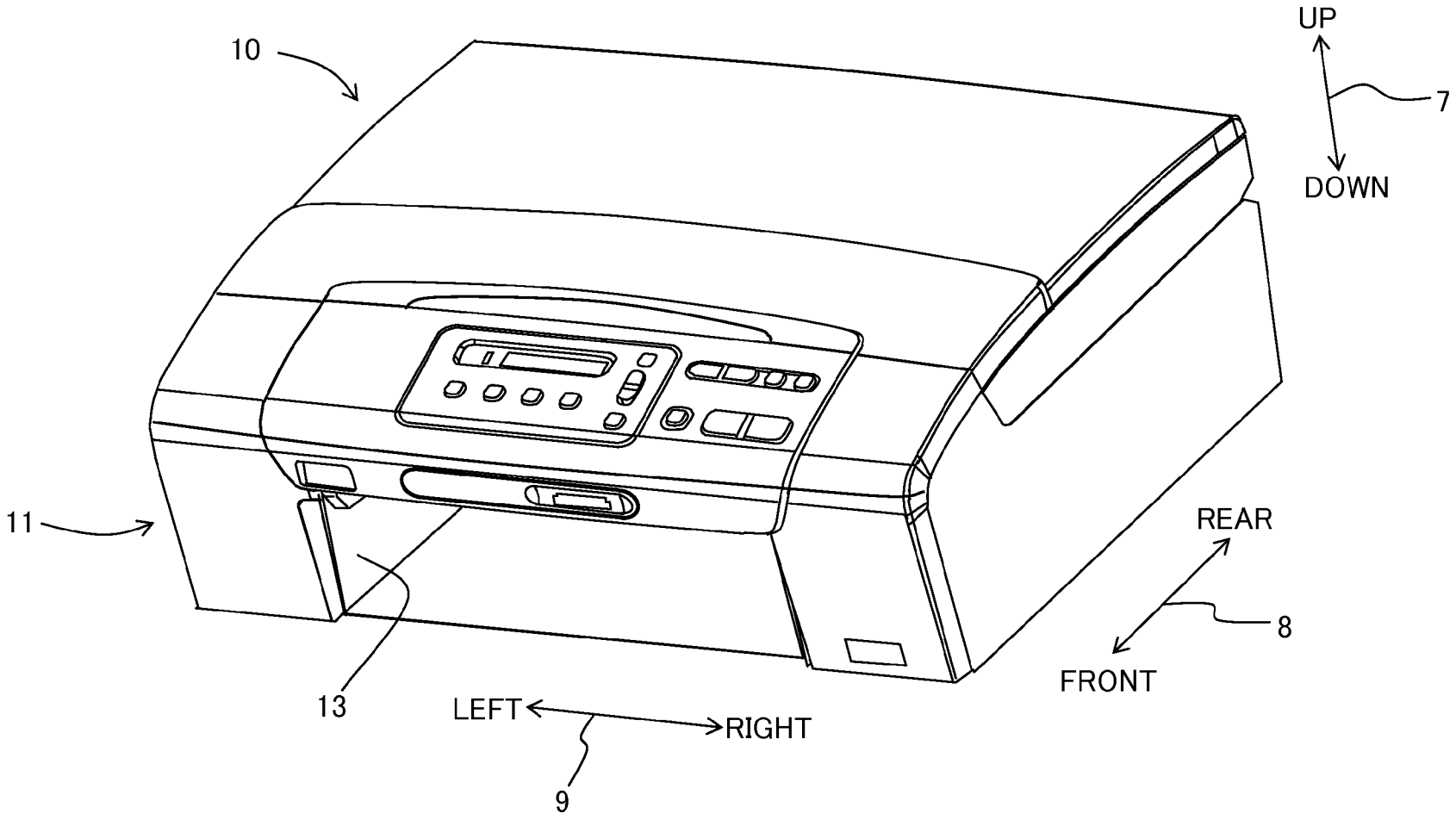
FIG. 1 is a perspective view of a multifunction printer 10.

Hereinbelow, referring appropriately to the accompanying drawings, an embodiment of the present teaching will be explained. Further, it is needless to say that the embodiment to be explained below is merely an example of the present teaching, and it is possible to appropriately change the embodiment of the present teaching without departing from the true spirit and scope of the present teaching. A multifunction printer 10 is placed and used in such a state as shown in FIG. 1. In this embodiment, a vertical or up-down direction 7 is defined with reference to the state that the multifunction printer 10 is placed to be usable (i.e., the state shown in FIG. 1), a depth or front-rear direction 8 is defined with an opening 13 being formed on the near side (i.e., the front side), and a horizontal or left-right direction 9 is defined as the multifunction printer 10 is viewed from the near side. The three directions shown in FIG. 1 are also presented likewise in the other figures.

[General Structure of the Multifunction Printer 10]

As shown in FIG. 1, the multifunction printer 10 (an example of the image recording apparatus of the present teaching) includes a printer portion 11 in its lower part. The multifunction printer 10 has various functions such as a facsimile function, a print function, etc. As the print function, it has a double-side image recording function to record images on both sides of a sheet of recording paper 12 (an example of the sheet of the present teaching; see FIG. 2). The printer portion 11 has the opening 13 formed in its front side. Further, a feeding tray 20 capable of loading the recording paper 12 (see FIG. 2), and a discharge tray 21 (see FIG. 12) are insertable to and removable from the opening 13 in the front-rear direction 8. Further, the media for the multifunction printer 10 to record images are not limited to the recording paper 12. For example, the multifunction printer 10 may also record images on the label side of a CD or DVD. In such case, the CD or DVD is loaded on a thin-plate-like media tray, and inserted into the multifunction printer 10 from the opening 13 or the like.

Figure 2:
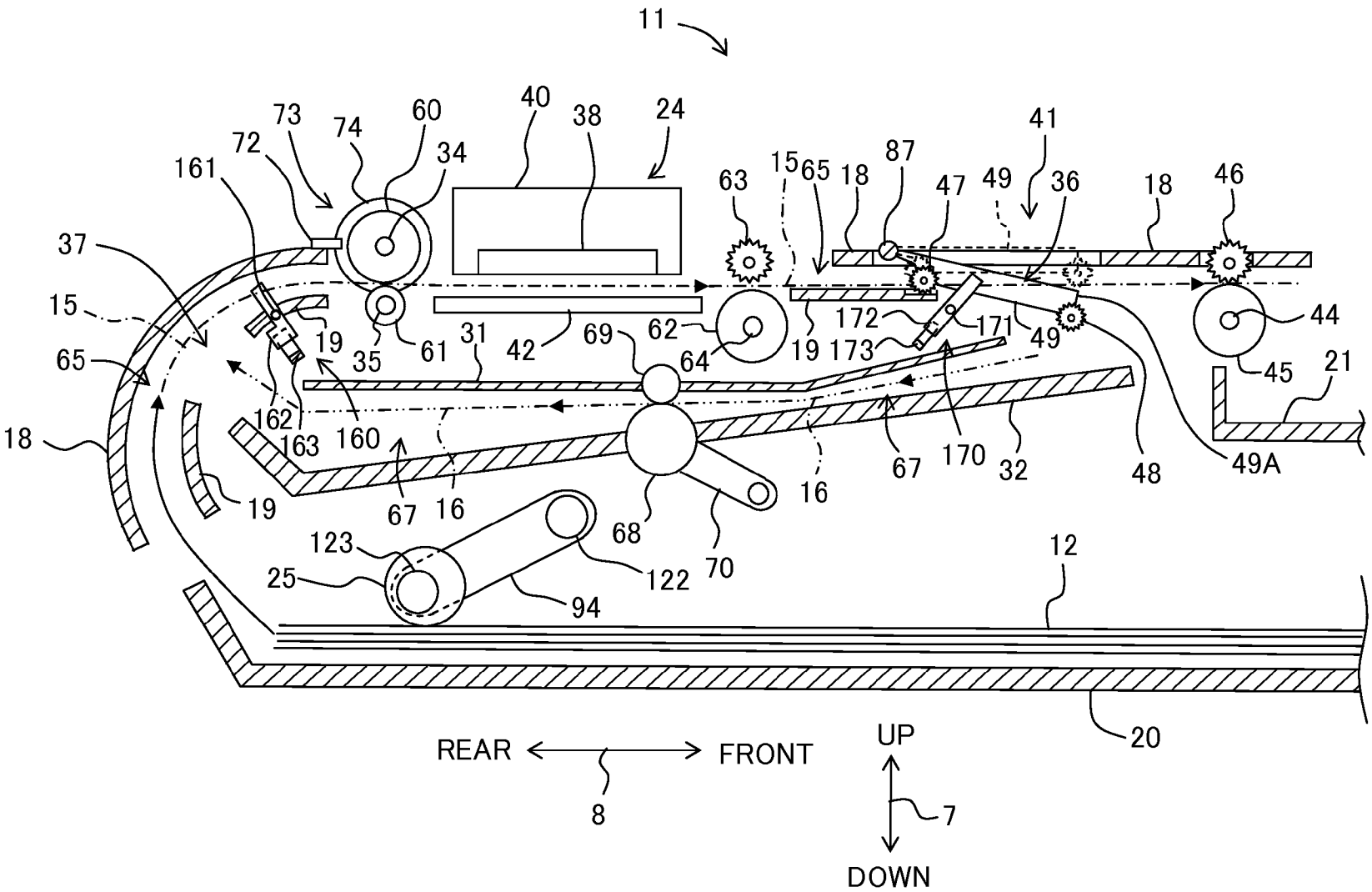
FIG. 2 is a vertical cross-sectional view schematically showing an internal structure of a printer portion 11.

As shown in FIG. 2, a feed roller 25 is provided above the feeding tray 20. The feeding roller 25 is provided to be contactable with the upper surface of the recording paper 12 loaded on the feeding tray 20. A reverse rotation driving force of a transporting motor 71 (see FIGS. 3 to 5) is applied to the feeding roller 25 to normally rotate the feeding roller 25. Further, the normal rotation of the feeding roller 25 refers to a rotation in such an orientation as to send out the recording paper 12 into a first transporting path 65 and to transport the recording paper 12 in a first transporting orientation 15 through the first transporting path 65. That is, the normal rotation or the normal rotation of the feeding roller 25 is a clockwise rotation as the printer portion 11 is viewed from the direction facing FIG. 2.

Inside the printer portion 11 (an example of the main body of the present teaching), the first transporting path 65 extends out from a rear-end portion of the feeding tray 20. The first transporting path 65 includes a curved portion and a linear portion. The first transporting path 65 is defined by an outer guide member 18 and an inner guide member 19 which face each other at a predetermined interval. The recording paper 12 contained by the feeding tray 20 is transported to U-turn along the curved portion from the lower side to the upper side, and then transported to a recording portion 24 via the linear portion. The recording paper 12 with images recorded by the recording portion 24 is transported via the linear portion and discharged to the discharge tray 21. That is, the recording paper 12 is transported in the first transporting orientation 15 shown by the arrows on the one-dot chain line in FIG. 2.

Further, a second transporting path 67 is also provided inside the printer portion 11. The second transporting path 67 is a path which extends in such a manner as to branch from the first transporting path 65 at a branch position 36, and rejoin the first transporting path 65 at a junction position 37 on the upstream side to the branch position 36 in the first transporting orientation 15. That is, the second transporting path 67 is connected with the first transporting path 65 at the branch position 36 as well as at the junction position 37. The second transporting path 67 is defined by guide members 31 and 32 which face each other in the up-down direction 7. After being switched back at the branch position 36, the recording paper 12 is transported through the second transporting path 67 from the branch position 36 toward the junction position 37 in a second transporting orientation 16 (the orientation shown by the arrows on the two-dot chain line in FIG. 2), and guided into the first transporting path 65 again.

[Transporting Roller Pair, Discharge Roller Pair, Reversal Roller Pair, and Re-Transporting Roller Pair]

As shown in FIG. 2, along the first transporting path 65, there are provided a transporting roller pair which includes a first transporting roller 60 and a pinch roller 61 on the upstream side to the recording portion 24 in the first transporting orientation 15, a discharge roller pair which includes a second transporting roller 62 and a spur 63 on the downstream side from the recording portion 24 in the first transporting orientation 15, and a reversal roller pair which includes a third transporting roller 45 and a spur 46 on the downstream side from the second transporting roller 62 in the first transporting orientation 15. Further, although illustration is omitted in FIGS. 3 to 5, at the second transporting path 67, there is provided a re-transporting roller pair which includes a fourth transporting roller 68, a driven roller 69, and an arm 70. Each of the roller pairs rotates with the recording paper 12 being sandwiched therebetween to transport the recording paper 12.

The transporting roller pair is provided on the downstream side from the junction position 37 and on the upstream side to the recording portion 24 in the first transporting orientation 15. In this embodiment, the first transporting roller 60 is arranged above the first transporting path 65 to contact with the recording surface of the recording paper 12 transported through the first transporting path 65 (i.e., the surface for the recording portion 24 to record images). An axle 34 is fitted into the first transporting roller 60, and caused to rotate integrally with the first transporting roller 60 by a driving force applied from the transporting motor 71 capable of normal rotation driving and reverse rotation driving. On the other hand, the pinch roller 61 is arranged below the first transporting path 65 to face the first transporting roller 60. The pinch roller 61 is driven to rotate along with the rotation of the first transporting roller 60. The first transporting roller 60 and pinch roller 61 cooperate to sandwich the recording paper 12 and transport the recording paper 12 in the first transporting orientation 15.

The driving force from the transporting motor 71 in the normal rotation driving mode is applied to the first transporting roller 60 to normally rotate the first transporting roller 60. Here, the normal rotation of the first transporting roller 60 refers to the rotation in the orientation to transport the recording paper 12 in the first transporting orientation 15. That is, when the printer portion 11 is viewed from the direction facing FIG. 2, then the normal rotation of the first transporting roller 60 is a counterclockwise rotation, whereas the normal rotation of the pinch roller 61 is a clockwise rotation. Hereinbelow, whenever the term "normal rotation of the transporting roller pair" is used, it denotes that the first transporting roller 60 shown in FIG. 2 rotates counterclockwise, and the pinch roller 61 rotates clockwise.

On the other hand, the driving force from the transporting motor 71 in the reverse rotation driving mode is applied to the first transporting roller 60 to reversely rotate the first transporting roller 60. The reverse rotation of the first transporting roller 60 refers to the rotation in the orientation to transport the recording paper 12 in the opposite orientation to the first transporting orientation 15. That is, the reverse rotation of the first transporting roller 60 viewed from the direction facing FIG. 2 is a clockwise rotation, whereas the reverse rotation of the pinch roller 61 is a counterclockwise rotation. Hereinbelow, whenever the term "reverse rotation of the transporting roller pair" is used, it denotes that the first transporting roller 60 shown in FIG. 2 rotates clockwise, and the pinch roller 61 rotates counterclockwise.

The discharge roller pair is provided on the downstream side from the recording portion 24 and on the upstream side to the branch position 36 in the first transporting orientation 15. In this embodiment, the second transporting roller 62 is arranged below the first transporting path 65 to contact with the back surface on the opposite side to the recording surface of the recording paper 12 transported through the first transporting path 65. An axle 64 is fitted into the second transporting roller 62, and caused to rotate integrally with the second transporting roller 62 by the driving force from the transporting motor 71. On the other hand, the spur 63 is arranged above the first transporting path 65 to face the second transporting roller 62. The spur 63 is driven to rotate along with the rotation of the second transporting roller 62. The second transporting roller 62 and spur 63 cooperate to sandwich the recording paper 12 and transport the recording paper 12 in the first transporting orientation 15.

The driving force from the transporting motor 71 in the normal rotation driving mode is applied to the second transporting roller 62 to normally rotate the second transporting roller 62. Here, the normal rotation of the second transporting roller 62 refers to the rotation in the orientation to transport the recording paper 12 in the first transporting orientation 15. That is, the normal rotation of the second transporting roller 62 viewed from the direction facing FIG. 2 is a clockwise rotation, whereas the normal rotation of the spur 63 is a counterclockwise rotation. Hereinbelow, whenever the term "normal rotation of the discharge roller pair" is used, it denotes that the second transporting roller 62 shown in FIG. 2 rotates clockwise, and the spur 63 rotates counterclockwise.

On the other hand, the driving force from the transporting motor 71 in the reverse rotation driving mode is applied to the second transporting roller 62 to reversely rotate the second transporting roller 62. The reverse rotation of the second transporting roller 62 refers to the rotation in the orientation to transport the recording paper 12 in the opposite orientation to the first transporting orientation 15. That is, the reverse rotation of the second transporting roller 62 viewed from the direction facing FIG. 2 is a counterclockwise rotation, whereas the reverse rotation of the spur 63 is a clockwise rotation. Hereinbelow, whenever the term "reverse rotation of the discharge roller pair" is used, it denotes that the second transporting roller 62 shown in FIG. 2 rotates counterclockwise, and the spur 63 rotates clockwise.

The reversal roller pair is provided on the downstream side from the branch position 36 in the first transporting orientation 15. In this embodiment, the third transporting roller 45 is arranged below the first transporting path 65 to contact with the back surface on the opposite side to the recording surface of the recording paper 12 transported through the first transporting path 65. An axle 44 is fitted into the third transporting roller 45, and caused to rotate integrally with the third transporting roller 45 by the driving force from the transporting motor 71. On the other hand, the spur 46 is arranged above the first transporting path 65 to face the third transporting roller 45. The spur 46 is driven to rotate along with the rotation of the third transporting roller 45. The third transporting roller 45 and spur 46 cooperate to sandwich the recording paper 12 and transport the recording paper 12 in the first transporting orientation 15 or in the second transporting orientation 16.

The driving force from the transporting motor 71 in the normal rotation driving mode is applied to the third transporting roller 45 to normally rotate the third transporting roller 45. Here, the normal rotation of the third transporting roller 45 refers to the rotation in the orientation to transport the recording paper 12 in the first transporting orientation 15. That is, the normal rotation of the third transporting roller 45 viewed from the direction facing FIG. 2 is a clockwise rotation, whereas the normal rotation of the spur 46 is a counterclockwise rotation. Hereinbelow, whenever the term "normal rotation of the reversal roller pair" is used, it denotes that the third transporting roller 45 shown in FIG. 2 rotates clockwise, and the spur 46 rotates counterclockwise.

On the other hand, the driving force from the transporting motor 71 in the reverse rotation driving mode is applied to the third transporting roller 45 to reversely rotate the third transporting roller 45. The reverse rotation of the third transporting roller 45 refers to the rotation in the orientation to transport the recording paper 12 in the opposite orientation to the first transporting orientation 15. That is, the reverse rotation of the third transporting roller 45 viewed from the direction facing FIG. 2 is a counterclockwise rotation, whereas the reverse rotation of the spur 46 is a clockwise rotation. Hereinbelow, whenever the term "reverse rotation of the reversal roller pair" is used, it denotes that the third transporting roller 45 shown in FIG. 2 rotates counterclockwise, and the spur 46 rotates clockwise.

The re-transporting roller pair is provided at the second transporting path 67. In this embodiment, the fourth transporting roller 68 is arranged below the second transporting path 67. Further, the fourth transporting roller 68 is an example of the driving roller of the present teaching. A driving force from the transporting motor 71 capable of normal rotation driving and reverse rotation driving is applied to the fourth transporting roller 68 to rotate the fourth transporting roller 68. On the other hand, the driven roller 69 is arranged above the second transporting path 67 to face the fourth transporting roller 68. The driven roller 69 is driven to rotate along with the rotation of the fourth transporting roller 68. The fourth transporting roller 68 and driven roller 69 cooperate to sandwich the recording paper 12 and transport the recording paper 12 in the second transporting orientation 16.

As shown in FIG. 2, the arm 70 supports the fourth transporting roller 68 to let the fourth transporting roller 68 be rotatable at its one end, and is supported at the other end to let itself be revolvable relative to the printer portion 11. Further, the end of the arm 70 supported by the printer portion 11 is arranged on the upstream side to the end supporting the fourth transporting roller 68 in the second transporting orientation 16. By virtue of this, the arm 70 is able to cause the fourth transporting roller 68 to contact with or separate from the driven roller 69. In more detail, when a force in the opposite orientation to the second transporting orientation 16 is applied to the recording paper 12 sandwiched by the re-transporting roller pair, then the arm 70 operates to press the fourth transporting roller 68 against the driven roller 69.

The fourth transporting roller 68 rotates normally regardless of the rotary orientations of the transporting motor 71 (normal rotation driving and reverse rotation driving). Here, the normal rotation of the fourth transporting roller 68 refers to the rotation in the orientation to transport the recording paper 12 in the second transporting orientation 16. That is, the normal rotation of the fourth transporting roller 68 viewed from the direction facing FIG. 2 is a counterclockwise rotation, whereas the normal rotation of the driven roller 69 is a clockwise rotation. Hereinbelow, whenever the term "normal rotation of the re-transporting roller pair" is used, it denotes that the fourth transporting roller 68 shown in FIG. 2 rotates counterclockwise, and the driven roller 69 rotates clockwise.

Further, it is desirable to set a larger amount of transportation per unit time for the re-transporting roller pair than for the transporting roller pair. By virtue of this, it is possible to restrain the recording paper 12 from sticking to the inner side of the transporting path. Further, without being limited particularly, any specific method may be used to increase the amount of transportation per unit time for the re-transporting roller pair. For example, the fourth transporting roller 68 may be configured to have a larger diameter than the first transporting roller 60, or the speed reduction ratio through the driving force transmission path from the transporting motor 71 to the fourth transporting roller 68 may be configured to be lower than the speed reduction ratio through the driving force transmission path from the transporting motor 71 to the first transporting roller 60.

[Recording Portion 24]

As shown in FIG. 2, the recording portion 24 is provided over the first transporting path 65 on the downstream side from the first transporting roller 60 in the first transporting orientation 15 and on the upstream side to the second transporting roller 62 in the first transporting orientation 15. A platen 42 is provided at such a position as below the recording portion 24 to face the recording portion 24 across the first transporting path 65. The platen 42 supports the recording paper 12 transported through the first transporting path 65. The recording portion 24 uses a publicly known ink jet method to record images on the recording paper 12 supported by the platen 42. The recording portion 24 includes a recording head 38 formed with a plurality of nozzles to jet ink drops onto the recording paper 12, and a carriage 40 carrying the recording head 38.

By the frame and the like of the printer portion 11, the carriage 40 is supported to be reciprocatingly movable in the left-right direction 9 orthogonal to the front-rear direction 8. Further, the left-right direction 9 is an example of the scanning direction of the present teaching. The carriage 40 is connected with a carriage driving motor 53 shown in FIG. 9 via a publicly known belt mechanism. A driving force is transmitted from the carriage driving motor 53 to the carriage 40 to move the carriage 40 reciprocatingly in the left-right direction 9. The carriage 40 is moved reciprocatingly with the recording paper 12 being supported by the platen 42. When the carriage 40 is moving reciprocatingly, ink drops are jetted from the recording head 38. By virtue of this, images are recorded on the recording paper 12 supported by the platen 42.

[First Sensor 160 and Second Sensor 170]

As shown in FIG. 2, a first sensor 160, which is an example of the detection portion of the present teaching, is provided at a position with the first transporting path 65 on the upstream side to the first transporting roller 60 in the first transporting orientation 15 and on the downstream side from the junction position 37 in the first transporting orientation 15. The first sensor 160 includes an axle 161, a detector 162 revolvable about the axle 161, and an optical sensor 163 having a light emitting element and a light receiving element which receives the light emitted from the light emitting element.

One end of the detector 162 projects into the first transporting path 65. When no external force is applied to the one end of the detector 162, then the other end of the detector 162 comes into an optical path from the light emitting element of the optical sensor 163 to the light receiving element, so as to block the light passing through the optical path. On this occasion, the optical sensor 163 outputs a low-level signal (a "signal whose signal level is lower than a threshold value", and an example of the second detection signal of the present teaching) to an aftermentioned control portion 130. On the other hand, when the one end of the detector 162 is pressed to rotate by the downstream end of the recording paper 12 in the first transporting orientation 15, then the other end of the detector 162 comes away from the optical path such that the light passes through the optical path. On this occasion, the optical sensor 163 outputs a high-level signal (a "signal whose signal level is not lower than the threshold value", and an example of the first detection signal of the present teaching) to the control portion 130. That is, the first sensor 160 outputs different detection signals to the control portion 130 according to the presence and the absence of the recording paper 12 at the position where the first sensor 160 is installed, respectively.

A second sensor 170 is provided at the first transporting path 65 on the downstream side from the recording portion 24 and second transporting roller 62 in the first transporting orientation 15 and on the upstream side to the branch position 36 in the first transporting orientation 15. In the same manner as the first sensor 160, the second sensor 170 includes an axle 171, a detector 172, and an optical sensor 173. Still in the same manner as the first sensor 160, the second sensor 170 outputs different detection signals to the control portion 130 according to the presence and the absence of the recording paper 12 at the position where the second sensor 170 is installed, respectively.

[Rotary Encoder 73]

As shown in FIG. 2, the first transporting roller 60 is provided with a rotary encoder 73 which is caused to generate a pulse signal by the rotation of the first transporting roller 60. The rotary encoder 73 is composed of an encoder disk 74 provided on the axle 34 of the first transporting roller 60 to rotate together with the first transporting roller 60, and an optical sensor 72 provided to clip the encoder disk 74 from the thickness directions (the directions perpendicular to the page of FIG. 2). The encoder disk 74 has transmission portions through which light is transmitted, and non-transmission portions through which light is not transmitted, the transmission and non-transmission portions being arranged alternately with a regular pitch in the circumferential direction. The optical sensor 72 irradiates the encoder disk 74 with the light from a light emitting portion (not shown), and receives the light transmitted through the encoder disk 74 with a light receiving portion (not shown).

When the light emitting portion of the optical sensor 72 faces any of the transmission portions of the encoder disk 74, the light receiving portion receives the light outputted from the light emitting portion. On this occasion, the optical sensor 72 outputs the high-level signal to the control portion 130. On the other hand, when the light emitting portion of the optical sensor 72 faces any of the non-transmission portions of the encoder disk 74, the light receiving portion does not receive the light outputted from the light emitting portion. On this occasion, the optical sensor 72 outputs the low-level signal to the control portion 130. As a result, because the encoder disk 74 rotates (in other words, the transporting motor 71 or the first transporting roller 60 rotates), the pulse signal is outputted from the optical sensor 72 to the control portion 130.

[Path Switching Member 41]

As shown in FIG. 2, a path switching member 41 is provided over the first transporting path 65 on the downstream side from the second transporting roller 62 in the first transporting orientation 15 and on the upstream side to the third transporting roller 45 in the first transporting orientation 15 (that is, at the branch position 36). The path switching member 41 includes auxiliary rollers 47 and 48, a flap 49, and an axle 87. The flap 49 extends out from the axle 87 approximately in the first transporting orientation 15, and is pivotally supported by the axle 87 to be revolvable. Further, the spur-like auxiliary rollers 47 and 48 are pivotally supported by the flap 49 to be rotatable. The flap 49 is configured to be changeable in posture, by revolving about the axle 87, between a discharge posture (the posture shown by the broken line in FIG. 2) positioned above the inner guide member 19 at the branch position 36, and a reversal posture (the posture shown by the solid line in FIG. 2) with an extensional end 49A being positioned below the branch position 36.

The flap 49 normally assumes the reversal posture due to its own weight. Then, being raised by the recording paper 12 transported through the first transporting path 65, the flap 49 revolves about the axle 87 to change in posture from the reversal posture to the discharge posture. Thereafter, the flap 49 (in detail, the auxiliary rollers 47 and 48) comes in contact with the recording paper 12 to guide the recording paper 12. When the upstream end of the recording paper 12 in the first transporting orientation 15 (i.e., the posterior end) has passed the auxiliary roller 47, the flap 49 changes from the discharge posture to the reversal posture due to its own weight. By virtue of this, the posterior end of the recording paper 12 in the first transporting orientation 15 faces downward (that is, toward the entrance of the second transporting path 67). In this state, when the third transporting roller 45 continues rotating normally, then the recording paper 12 is transported onward in the first transporting orientation 15 to be discharged to the discharge tray 21. On the other hand, when the rotation of the third transporting roller 45 is switched from the normal rotation to the reverse rotation, then the recording paper 12 is guided into the second transporting path 67 with the upstream end as the anterior end in the first transporting orientation 15.

[Driving Force Transmission Mechanism 50]

Figure 3:
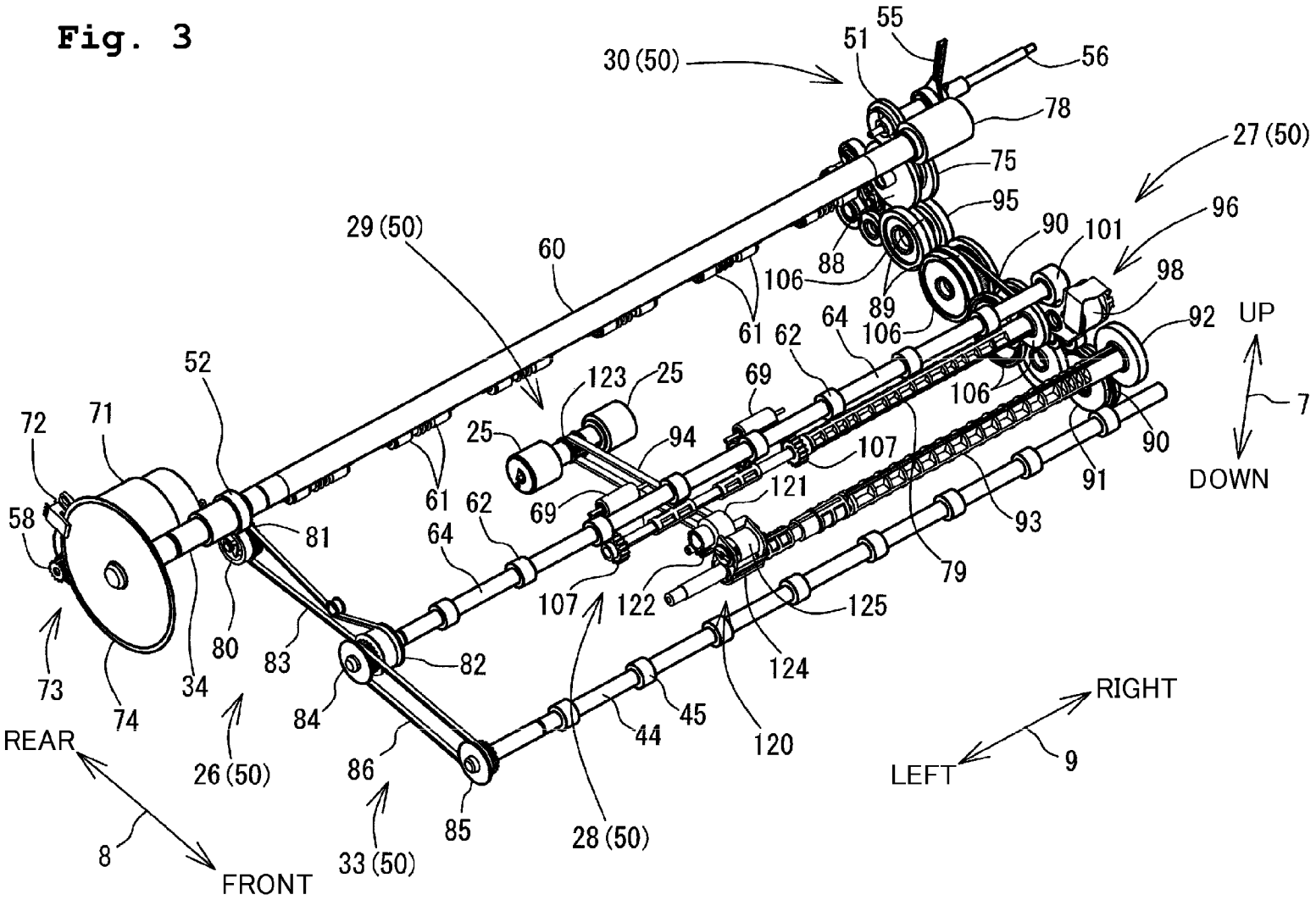
FIG. 3 is a perspective view showing the internal structure of the printer portion 11.
Figure 4:
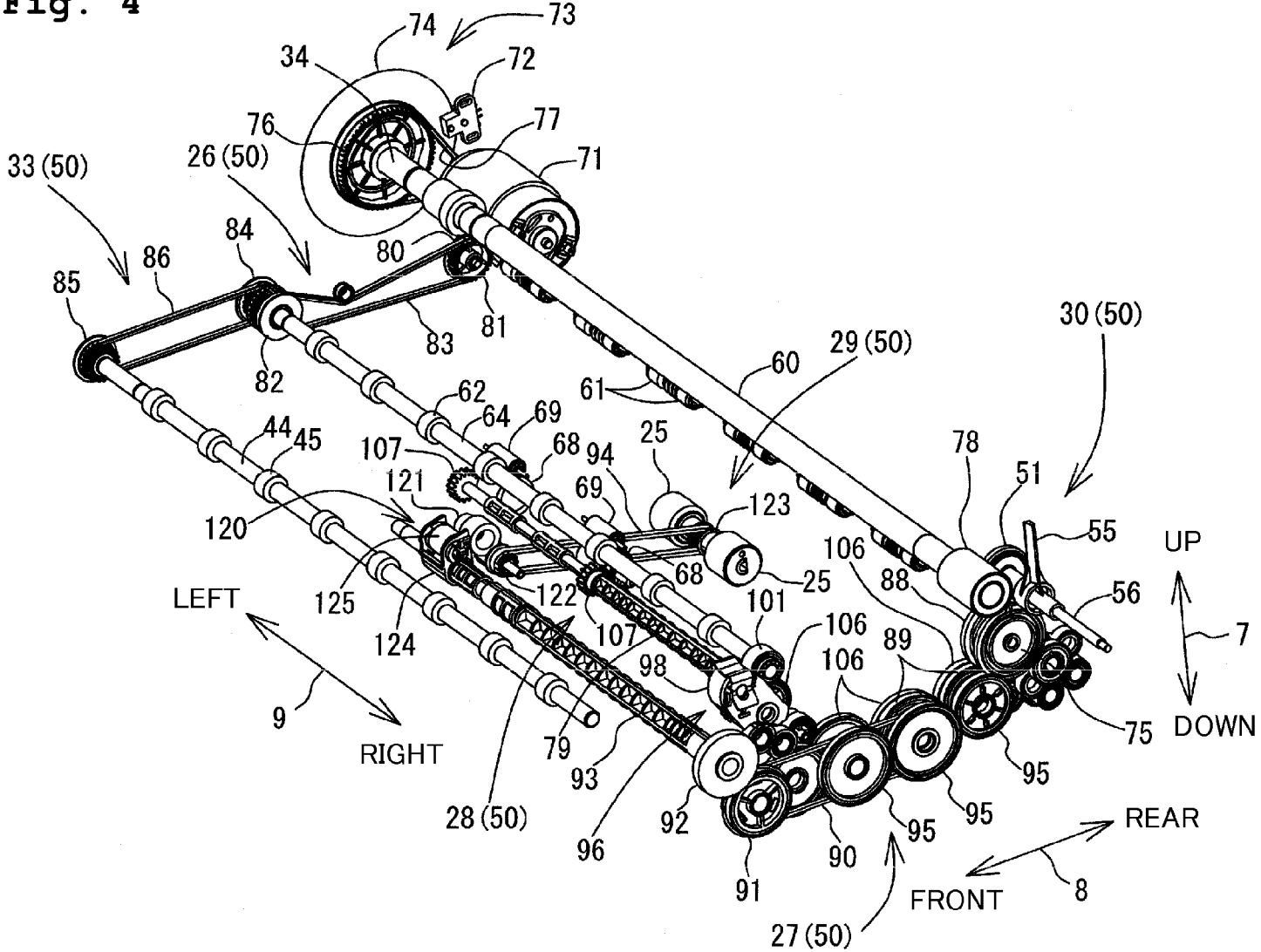
FIG. 4 is another perspective view showing the internal structure of the printer portion 11.
Figure 5:
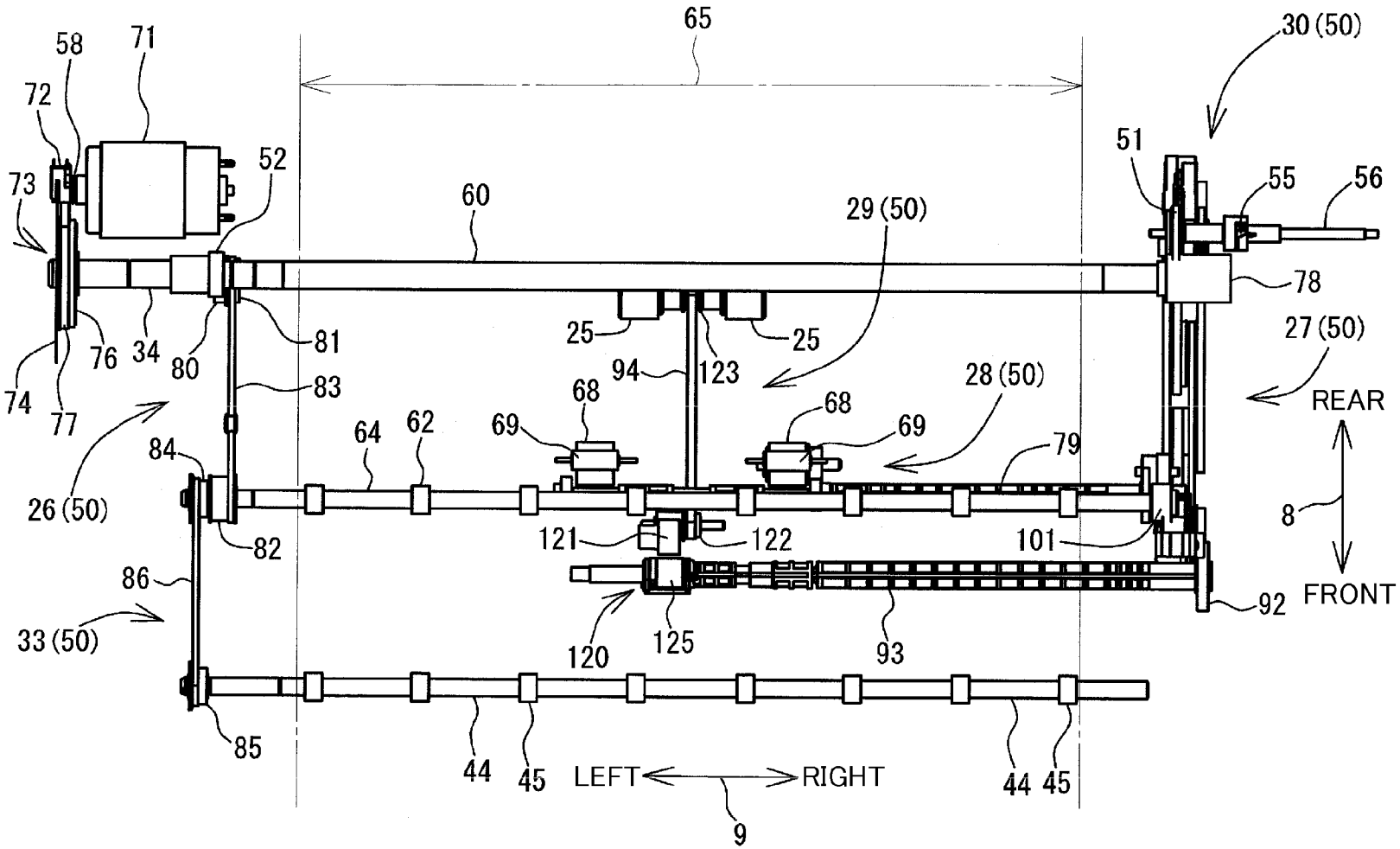
FIG. 5 is a plan view showing the internal structure of the printer portion 11.

As shown in FIGS. 3 to 5, the printer portion 11 is provided with a driving force transmission mechanism 50 which transmits the driving force of the transporting motor 71 to each of the roller pairs. The driving force transmission mechanism 50 includes a roller pulley 76, a motor pulley 58, a first belt 77, a first driving force transmission portion 26, a second driving force transmission portion 27, a third driving force transmission portion 33, a fourth driving force transmission portion 28, a feed driving force transmission portion 29, and a switching portion 30. The transporting motor 71 and driving force transmission mechanism 50 are an example of the driving force transmission portion of the present teaching.

As shown in FIG. 5, the roller pulley 76 is fitted on the axle 34 of the first transporting roller 60 on the left side of the first transporting path 65. As shown in FIGS. 3 to 5, the transporting motor 71 is fitted with the motor pulley 58 on the rotating axle of the transporting motor 71. The endless first belt 77 is fastened on the roller pulley 76 and motor pulley 58. By virtue of this, the rotary driving force of the transporting motor 71 is transmitted to the first transporting roller 60. As shown specifically in FIG. 8, the first transporting roller 60 rotates normally when the transporting motor 71 is driven to rotate normally, and rotates reversely when the transporting motor 71 is driven to rotate reversely.

[First Driving Force Transmission Portion 26]

As shown in FIGS. 3 to 6, the first driving force transmission portion 26 includes a left gear 52, a lower gear 80, a first pulley 81, a second pulley 82, and a second belt 83. The left gear 52 is provided on the axle 34 of the first transporting roller 60 on the left side of the first transporting path 65. The lower gear 80 engages the left gear 52 at the lower side of the left gear 52. The first pulley 81 is fitted on the right side of the lower gear 80 to rotate coaxially and integrally with the lower gear 80. By virtue of this, the first pulley 81 rotates in coordination with the rotation of the first transporting roller 60. The second pulley 82 is fitted on the axle 64 of the second transporting roller 62. The endless second belt 83 is fastened on the first pulley 81 and second pulley 82.

Further, a publicly known one-way clutch (in particular, a needle clutch) is provided inside of the second pulley 82. That is, the second pulley 82 is fitted on the axle 64 via the one-way clutch. By virtue of this, to the second transporting roller 62, the first driving force transmission portion 26 transmits the rotary driving force of the transporting motor 71 when driven to rotate normally, but does not transmit the rotary driving force of the transporting motor 71 when driven to rotate reversely. That is, as shown in FIG. 8, the second transporting roller 62 rotates normally due to the normal rotation driving force of the transporting motor 71, transmitted by the first driving force transmission portion 26.

[Third Driving Force Transmission Portion 33]

As shown in FIGS. 3 to 6, the third driving force transmission portion 33 includes a third pulley 84, a fourth pulley 85, and a third belt 86. The third pulley 84 is fitted on the axle 64 on the left side of the second pulley 82 to rotate coaxially and integrally with the second pulley 82. The fourth pulley 85 is fitted on the axle 44 of the third transporting roller 45. The endless third belt 86 is fastened on the third pulley 84 and fourth pulley 85. By virtue of this, the rotation of the second transporting roller 62 is transmitted to the third transporting roller 45 via the third belt 86. That is, as shown in FIG. 8, in the same manner as the second transporting roller 62, the third transporting roller 45 rotates normally due to the normal rotation driving force of the transporting motor 71, transmitted by the first driving force transmission portion 26 and third driving force transmission portion 33.

[Second Driving Force Transmission Portion 27]

As shown in FIGS. 3 to 6, the second driving force transmission portion 27 is constituted by a first gear 78, a first output gear 75, a plurality of first intermediate gears 95 engaging each other, a second gear 101, and a first pendulum gear mechanism 96. The first pendulum gear mechanism 96 includes a sun gear 97 engaging one of the first intermediate gears 95, a pendulum gear 98 to rotate as well as to revolve around the sun gear 97, and an arm 102.

The first gear 78 is provided on the axle 34 of the first transporting roller 60 on the right side of the first transporting path 65. The first gear 78 is provided coaxially with the first transporting roller 60 to rotate integrally with the first transporting roller 60. That is, when the first transporting roller 60 rotates, then the first gear 78 also rotates. The rotation of the first gear 78 is transmitted to the first output gear 75 via a switch gear 51 of the aftermentioned switching portion 30.

Figure 7B:
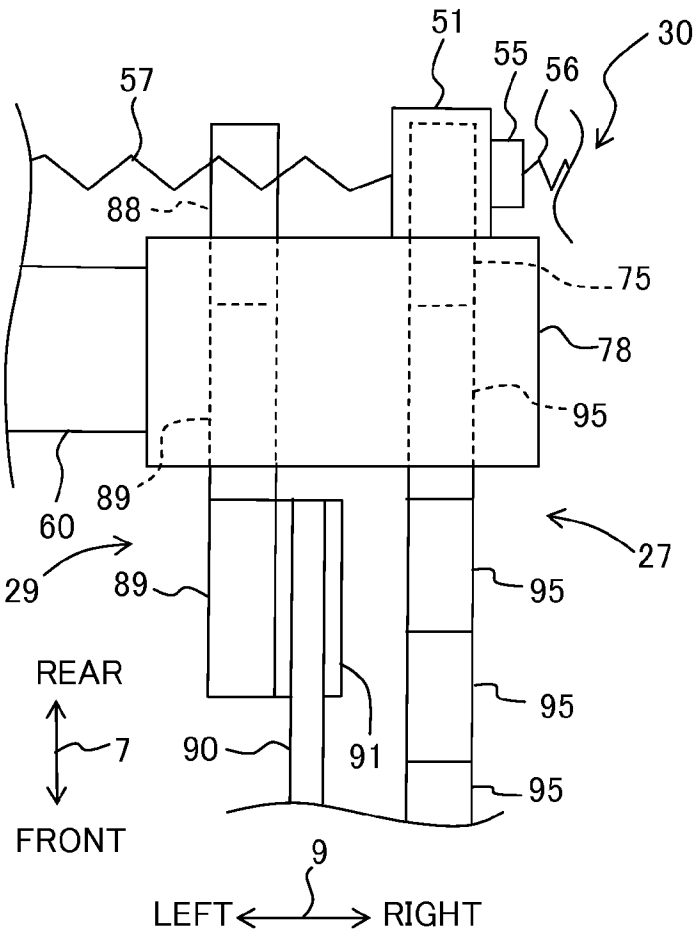
FIG. 7B is a plan view schematically showing engagements between the respective gears 51, 75, 78 and 88 when the switch gear 51 is at a second position.

The first output gear 75 engages the switch gear 51, the gear positioned on the most upstream side in the driving force transmission path among the first intermediate gears 95, and a sun gear 109 of the aftermentioned fourth driving force transmission portion 28. Further, as shown in FIG. 7B, the first output gear 75 engages the switch gear 51 situated at a second position, and is caused to rotate by the transmitted rotary driving force of the first gear 78.

Figure 6:
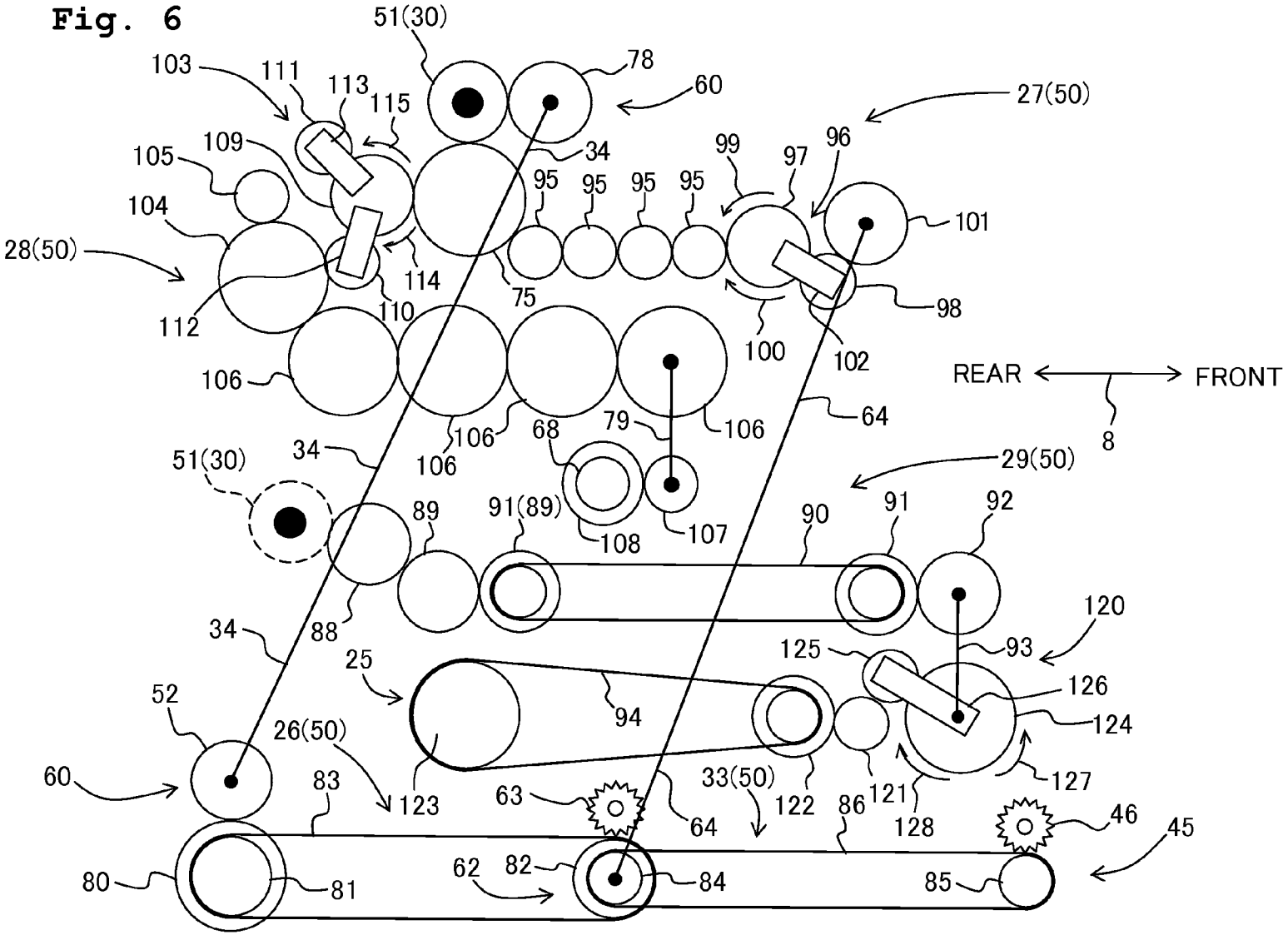
FIG. 6 is a schematic view showing a transmission relationship between rollers, belts, gears and pulleys of a driving force transmission mechanism 50.

The plurality of first intermediate gears 95 are arranged to engage each other and align approximately in the front-rear direction 8. In this embodiment, an even number of first intermediate gears 95 are arranged. Further, although four first intermediate gears 95 are depicted in FIG. 6 for convenience, it is needless to say that they are not limited to four. The first intermediate gear 95 arranged on the most downstream side in the driving force transmission path engages the sun gear 97 of the first pendulum gear mechanism 96. In the above manner, the rotary driving force of the first gear 78 is transmitted to the sun gear 97 via the switch gear 51 at the second position, the first output gear 75, and the plurality of first intermediate gears 95.

The sun gear 97 is supported to be rotatable by the frame and the like of the printer portion 11. On end of the arm 102 is fitted on the thrust surface of the sun gear 97. By virtue of this, the arm 102 revolves coaxially with the sun gear 97. The pendulum gear 98 is supported to be rotatable on the other end of the arm 102. The pendulum gear 98 engages the sun gear 97. Thus, the pendulum gear 98 is supported by the arm 102 to rotate, as well as to revolve around the sun gear 97 in the rotary orientation of the sun gear 97 while engaging the sun gear 97.

Referring to FIG. 6, the following explanation will be made for the driving force transmission by the second driving force transmission portion 27. When the transporting motor 71 is driven to rotate reversely, then the first transporting roller 60 and first gear 78 rotate clockwise. Here, between the first gear 78 and the sun gear 97, the switch gear 51, first output gear 75, and even number of first intermediate gears 95 engage each other. That is, between the first gear 78 and the sun gear 97, an even number of gears engage each other. Therefore, when the first gear 78 rotates clockwise, then the sun gear 97 rotates counterclockwise (in the orientation of arrow 99).

When the sun gear 97 rotates counterclockwise, then the pendulum gear 98 rotates clockwise while revolving around the sun gear 97 in the orientation of arrow 99 to engage the second gear 101. The second gear 101 engaged by the pendulum gear 98 rotates counterclockwise. Here, the second gear 101 is provided on a right-end portion of the axle 64 of the second transporting roller 62 (see FIGS. 3 to 5), to rotate integrally with the second transporting roller 62. That is, as shown in FIG. 8, when the switch gear 51 is at the second position, then the second transporting roller 62 is caused to rotate reversely by the reverse rotation driving force of the transporting motor 71, transmitted by the second driving force transmission portion 27.

Further, the rotary driving force of the second transporting roller 62 rotating reversely is transmitted to the third transporting roller 45 via the third pulley 84, third belt 86, and fourth pulley 85. As a result, as shown in FIG. 8, when the switch gear 51 is at the second position, then the third transporting roller 45 is caused to rotate reversely by the reverse rotation driving force of the transporting motor 71, transmitted by the second driving force transmission portion 27 and third driving force transmission portion 33.

On the other hand, when the transporting motor 71 is in the normal rotation driving mode, then the first gear 78 rotates clockwise. Further, the rotary driving force of the first gear 78 is transmitted to the sun gear 97 to rotate the same clockwise (arrow 100). By virtue of this, the pendulum gear 98 rotates counterclockwise while revolving around the sun gear 97 in the orientation of arrow 100, to separate from the second gear 101. Therefore, the second driving force transmission portion 27 does not transmit the normal rotation driving force of the transporting motor 71 to the second transporting roller 62 and third transporting roller 45.

The roller pulley 76, motor pulley 58, first belt 77, first driving force transmission portion 26, second driving force transmission portion 27, and third driving force transmission portion 33 are an example of the first transmission mechanism of the present teaching, configured in the above manner to transmit the normal rotation driving force of the transporting motor 71 so as to normally rotate the first transporting roller 60, second transporting roller 62, and third transporting roller 45, as well as to transmit the reverse rotation driving force of the transporting motor 71 so as to reversely rotate the first transporting roller 60, second transporting roller 62, and third transporting roller 45.

[Fourth Driving Force Transmission Portion 28]

As shown in FIGS. 3 to 6, the fourth driving force transmission portion 28, which is an example of the second transmission mechanism of the present teaching, is constituted by a second pendulum gear mechanism 103, a normal rotation engagement gear 104, a reverse rotation engagement gear 105, a plurality of second intermediate gears 106 engaging each other, a third intermediate gear 107, and a third gear 108. The second pendulum gear mechanism 103 includes the sun gear 109 engaging the first output gear 75, two pendulum gears 110 and 111 rotating as well as revolving around the sun gear 109, and two arms 112 and 113.

The sun gear 109 is supported to be rotatable by the frame and the like of the printer portion 11. A driving force is transmitted from the first output gear 75 of the second driving force transmission portion 27 to the sun gear 109 to rotate the sun gear 109. In more detail, as shown in FIG. 7B, because the switch gear 51 at the second position engages the first output gear 75, the rotary driving force of the first gear 78 is transmitted to the fourth driving force transmission portion 28.

One end of each of the arms 112 and 113 is fitted on the thrust surface of the sun gear 109. By virtue of this, the arms 112 and 113 rotate coaxially with the sun gear 109. The pendulum gear 110 is supported to be rotatable on the other end of the arm 112. The pendulum gear 111 is supported to be rotatable on the other end of the arm 113. The pendulum gears 110 and 111 engage the sun gear 109. The pendulum gear 110 is supported by the arm 112 to rotate as well as to revolve in the rotary orientation of the sun gear 109 while engaging the sun gear 109. In the same manner, the pendulum gear 111 is supported by the arm 113 to rotate as well as to revolve in the rotary orientation of the sun gear 109 while engaging the sun gear 109.

The pendulum gear 110 is able to engage the normal rotation engagement gear 104, which is an example of the first gear of the present teaching. The pendulum gear 111 is able to engage the reverse rotation engagement gear 105, which is an example of the second gear of the present teaching. The normal rotation engagement gear 104, reverse rotation engagement gear 105, and plurality of second intermediate gears 106 form a gear row in which adjacent gear pairs engage each other. The reverse rotation engagement gear 105 engages the normal rotation engagement gear 104. The normal rotation engagement gear 104 engages the reverse rotation engagement gear 105, and the gear arranged on the most upstream side in the driving force transmission path among the second intermediate gears 106. That is, the normal rotation engagement gear 104 and the reverse rotation engagement gear 105 are adjacent to each other in the gear row.

The second intermediate gears 106 are arranged to engage each other and align approximately in the front-rear direction 8. In this embodiment, an even number of second intermediate gears 106 are arranged. Further, four second intermediate gears 106 are depicted in FIG. 6 for convenience. However, it is needless to say that this is just an exemplification in every way, and the second intermediate gears are not limited to four. The third intermediate gear 107 is provided coaxially with the gear arranged on the most downstream side in the driving force transmission path among the second intermediate gears 106. The third intermediate gear 107 rotates integrally with that second intermediate gear 106 about an axle 79 which is coaxial with that second intermediate gear 106. The third intermediate gear 107 engages the third gear 108. The third gear 108 is arranged coaxially with the fourth transporting roller 68 to be rotatable integrally with the fourth transporting roller 68.

Referring to FIG. 6, the following explanation will be made for the driving force transmission by the fourth driving force transmission portion 28. When the transporting motor 71 is driven to rotate normally, then the first transporting roller 60 and first gear 78 rotate counterclockwise, the switch gear 51 rotates clockwise, and the first output gear 75 rotates counterclockwise. Hence, the sun gear 109 rotates clockwise (in the orientation of arrow 114). The orientation of arrow 114 is an example of the first orientation of the present teaching. By virtue of this, the pendulum gear 110 rotates counterclockwise while revolving around the sun gear 109 in the orientation of arrow 114 to engage the normal rotation engagement gear 104. On the other hand, the pendulum gear 111 rotates counterclockwise while revolving around the sun gear 109 in the orientation of arrow 114 to separate from the reverse rotation engagement gear 105. The above posture of the fourth driving force transmission portion 28 is an example of the first posture of the present teaching. As a result, the normal rotation driving force of the transporting motor 71 is transmitted to the normal rotation engagement gear 104 to rotate the normal rotation engagement gear 104 clockwise.

Here, between the sun gear 109 and the third gear 108, the pendulum gear 110, normal rotation engagement gear 104, and even number of second intermediate gears 106 are connected in a row while engaging each other. Further, because the third intermediate gear 107 rotates coaxially and integrally with the second intermediate gear 106, it is not included in the above number. In the above manner, because the sun gear 109 rotates clockwise, the third gear 108 and fourth transporting roller 68 rotate counterclockwise. That is, as shown in FIG. 8, when the switch gear 51 is at the second position, then the fourth transporting roller 68 is caused to rotate normally by the normal rotation driving force of the transporting motor 71, transmitted by the fourth driving force transmission portion 28. That is, the fourth driving force transmission portion 28 transmits the normal rotation driving force of the transporting motor 71 with an even number of gears to normally rotate the fourth transporting roller 68.

On the other hand, when the transporting motor 71 is driven to rotate reversely, then the first transporting roller 60 and first gear 78 rotate clockwise, the switch gear 51 rotates counterclockwise, and the first output gear 75 rotates clockwise. Hence, the sun gear 109 rotates counterclockwise (in the orientation of arrow 115). The orientation of arrow 115 is an example of the second orientation of the present teaching. By virtue of this, the pendulum gear 110 rotates clockwise while revolving around the sun gear 109 in the orientation of arrow 115 to separate from the normal rotation engagement gear 104. On the other hand, the pendulum gear 111 rotates clockwise while revolving around the sun gear 109 in the orientation of arrow 115 to engage the reverse rotation engagement gear 105. The above posture of the fourth driving force transmission portion 28 is an example of the second posture of the present teaching. As a result, the normal rotation driving force of the transporting motor 71 is transmitted to the reverse rotation engagement gear 105 to rotate the reverse rotation engagement gear 105 counterclockwise.

Here, between the sun gear 109 and the third gear 108, the pendulum gear 111, reverse rotation engagement gear 105, normal rotation engagement gear 104, and even number of second intermediate gears 106 are connected in a row while engaging each other. That is, between the sun gear 109 and the third gear 108, an odd number of gears are connected in the row while engaging each other. In the above manner, because the sun gear 109 rotates counterclockwise, the third gear 108 and fourth transporting roller 68 rotate counterclockwise. That is, as shown in FIG. 8, when the switch gear 51 is at the second position, then the fourth transporting roller 68 is caused to rotate normally by the reverse rotation driving force of the transporting motor 71, transmitted by the fourth driving force transmission portion 28. That is, the fourth driving force transmission portion 28 transmits the reverse rotation driving force of the transporting motor 71 with an odd number of gears to normally rotate the fourth transporting roller 68.

[Feed Driving Force Transmission Portion 29]

As shown in FIGS. 3 to 6, the feed driving force transmission portion 29 is constituted by a second output gear 88, fourth intermediate gears 89, a fourth belt 90, two fifth intermediate gears 91, a sixth intermediate gear 92 fitted on an axle 93, a third pendulum gear mechanism 120, a seventh intermediate gear 121, an eighth intermediate gear 122, a fifth belt 94, and a feed pulley 123 coaxial with the feeding roller 25. The third pendulum gear mechanism 120 includes a sun gear 124 to be rotated integrally with the axle 93 about the axle 93, a pendulum gear 125 rotating as well as revolving around the sun gear 124, and an arm 126.

Figure 7A:
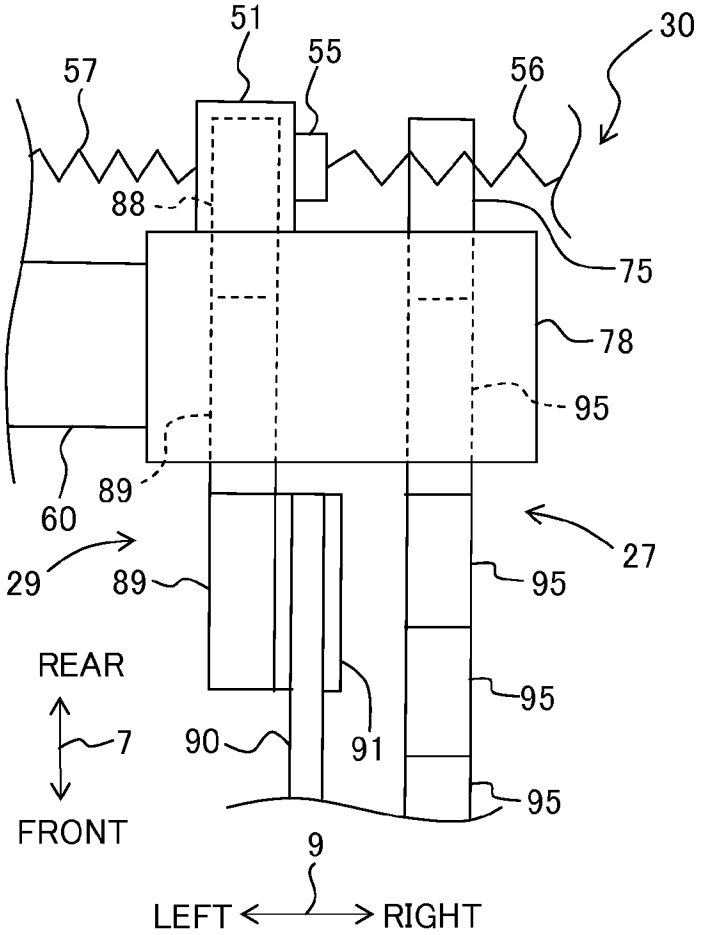
FIG. 7A is a plan view schematically showing engagements between respective gears 51, 75, 78 and 88 when the switch gear 51 is at a first position.

The second output gear 88 engages one of the fourth intermediate gears 89. Further, as shown in FIG. 7A, the second output gear 88 engages the switch gear 51 at a first position to let the rotary driving force of the first gear 78 be transmitted thereto. An even number (two in particular) of fourth intermediate gears 89 are provided in this embodiment. Then, the gear on the downstream side in the driving force transmission path between the fourth intermediate gears 89 is arranged coaxially with, and rotates integrally with, the gear on the upstream side in the driving force transmission path between the two fifth intermediate gears 91. The endless fourth belt 90 is fastened on the two fifth intermediate gears 91. In more detail, the fourth belt 90 is fastened on two pulleys (not shown) which are respectively arranged coaxially with, and rotate integrally with, the two fifth intermediate gears 91.

The gear arranged on the downstream side in the driving force transmission path between the two fifth intermediate gears 91 engages the sixth intermediate gear 92. The axle 93 is fitted into, and rotates integrally with, both the sun gear 124 of the third pendulum gear mechanism 120, and the sixth intermediate gear 92. One end of the arm 126 is fitted on the thrust surface of the sun gear 124. By virtue of this, the arm 126 revolves about the axle 93. The pendulum gear 125 is supported to be rotatable on the other end of the arm 126. The pendulum gear 125 engages the sun gear 124. Being configured in the above manner, the pendulum gear 125 is supported by the arm 126 to rotate as well as to revolve around the sun gear 124 in the rotary orientation of the sun gear 124 while engaging the sun gear 124.

The seventh intermediate gear 121 is arranged at a position capable of engaging the pendulum gear 125. Further, the seventh intermediate gear 121 engages the eighth intermediate gear 122. The endless fifth belt 94 is fastened on the eighth intermediate gear 122 and feed pulley 123. In detail, the fifth belt 94 is fastened on the feed pulley 123, and a pulley which is arranged coaxially with, and rotates integrally with, the eighth intermediate gear 122. Further, the feeding roller 25 and feed pulley 123 rotate coaxially and integrally.

Referring to FIG. 6, the following explanation will be made for the driving force transmission by the feed driving force transmission portion 29. When the transporting motor 71 is driven to rotate reversely, then the first transporting roller 60 and first gear 78 rotate clockwise. When the first gear 78 is rotated clockwise, then the switch gear 51 is rotated counterclockwise, the second output gear 88 is rotated clockwise, the engaged fourth intermediate gear 89 is rotated counterclockwise, and the two fifth intermediate gears 91 are rotated clockwise.

When the fifth intermediate gears 91 are rotated clockwise, then the sixth intermediate gear 92, and the sun gear 124 coaxial with the sixth intermediate gear 92 are rotated counterclockwise (in the orientation of arrow 127). When the sun gear 124 is rotated counterclockwise, then the pendulum gear 125 rotates clockwise while revolving around the sun gear 124 in the orientation of arrow 127 to engage the seventh intermediate gear 121. By virtue of this, the seventh intermediate gear 121 engaged by the pendulum gear 125 rotates counterclockwise.

When the seventh intermediate gear 121 rotates counterclockwise, then the eighth intermediate gear 122 and feed pulley 123 rotate clockwise. By virtue of this, the feeding roller 25, which rotates integrally with the feed pulley 123, is also rotated clockwise. That is, as shown in FIG. 8, when the switch gear 51 is at the first position, then the feeding roller 25 is caused to rotate normally by the reverse rotation driving force of the transporting motor 71, transmitted by the feed driving force transmission portion 29. As a result, the sheet of the recording paper 12 being loaded on the feeding tray 20 and contacting with the feeding roller 25, i.e., the uppermost-loaded sheet of the recording paper 12, is fed toward the first transporting roller 60.

On the other hand, when the transporting motor 71 is driven to rotate normally, then contrary to the occasion when the transporting motor 71 is driven to rotate reversely, the sun gear 124 is rotated clockwise (in the orientation of arrow 128). By virtue of this, the pendulum gear 125 rotates counterclockwise while revolving around the sun gear 124 in the orientation of arrow 128 to separate from the seventh intermediate gear 121. That is, the feed driving force transmission portion 29 does not transmit the normal rotation driving force of the transporting motor 71 to the feeding roller 25.

[Switching Portion 30]

As shown in FIGS. 3 through 7A and 7B, the switching portion 30 includes the switch gear 51, coil springs 56 and 57, and a switch lever 55.

As shown in FIGS. 7A and 7B, the switch gear 51, which is an example of the driving gear of the present teaching, engages the first gear 78. By virtue of this, the rotary driving force of the transporting motor 71 is transmitted to the switch gear 51 to rotate the switch gear 51. Further, being maintained in the state of engaging the first gear 78, the switch gear 51 is movable between the first position (see FIG. 7A) and the second position (see FIG. 7B) which are spaced apart in the left-right direction 9. The first position is situated on the left side of the second position. Both the first position and the second position are situated on the right side of the first transporting path 65.

As shown in FIG. 7A, the switch gear 51 at the first position engages the first gear 78 and the second output gear 88, but does not engage the first output gear 75. By virtue of this, the rotary driving force transmitted from the transporting motor 71 to the switch gear 51 via the first gear 78 is transmitted on to the feed driving force transmission portion 29. On the other hand, as shown in FIG. 7B, the switch gear 51 at the second position engages the first gear 78, and the first output gear 75, which is an example of the driven gear of the present teaching, but does not engage the second output gear 88. By virtue of this, the rotary driving force transmitted from the transporting motor 71 to the switch gear 51 via the first gear 78 is transmitted on to the second driving force transmission portion 27 and fourth driving force transmission portion 28.

As shown in FIGS. 7A and 7B, the switch lever 55 movable in the left-right direction 9 is arranged on the right lateral surface of the switch gear 51. As shown in FIG. 3, the switch lever 55 is provided to project upward to be exposed in the movement path of the carriage 40. That is, the switch lever 55 is caused to move by contact with the carriage 40 moving rightward in the left-right direction 9 according to FIGS. 3 to 5. Further, the coil spring 56 is fitted on the right side of the switch lever 55. The switch lever 55 and coil spring 56 are arranged in the axial direction of the switch gear 51. One end of the coil spring 56 is fitted on the right lateral surface of the switch lever 55, while the other end is fitted on the frame (not shown) or the like of the printer portion 11. Further, the coil spring 57 is fitted on the left side of the switch gear 51. One end of the coil spring 57 is fitted on the left lateral surface of the switch gear 51, while the other end is fitted on the frame (not shown) or the like of the printer portion 11.

That is, the switch lever 55 is biased by the coil spring 56 from the second position side to the first position side (i.e., leftward), and is biased by the coil spring 57 via the switch gear 51 from the first position side to the second position side (i.e., rightward). Further, the coil spring 56 has a greater biasing force than the coil spring 57. Therefore, when the carriage 40 has not yet contacted with the switch lever 55, the switch gear 51 is situated at the first position. On the other hand, when the carriage 40 has contacted with the switch lever 55 and caused the switch lever 55 to move rightward, the switch gear 51 is liberated from the biasing force of the coil spring 56, and caused to move rightward by the biasing force of the coil spring 57.

The switch gear 51 at the first position is restrained by a first stopper (not shown) from moving leftward due to the biasing force of the coil spring 56. By virtue of this, the switch gear 51 can remain at the first position. Further, with the switch gear 51 situated at the first position, when the switch lever 55 is pressed rightward by the carriage 40, then the switch gear 51 is liberated from the restraint by the first stopper, and caused to move from the first position to the second position (i.e., rightward) by the pressing force of the carriage 40.

Next, having moved from the first position to the second position due to the contact between the carriage 40 and switch lever 55, the switch gear 51 is restrained by a second stopper (not shown) from moving leftward due to the biasing force of the coil spring 56. By virtue of this, the switch gear 51 can remain at the second position. Further, with the switch gear 51 situated at the second position, when the switch lever 55 is further pressed rightward by the carriage 40, then the switch gear 51 is liberated from the restraint by the second stopper, and caused to move from the second position to the first position (i.e., leftward) by the biasing force of the coil spring 56.

In the above manner, the switching portion 30 switches the rotation of the first transporting roller 60 (i.e., the driving force of the transporting motor 71) to transmit or not to transmit the driving force to the second driving force transmission portion 27 and fourth driving force transmission portion 28, or to the feed driving force transmission portion 29. In particular, when the switch gear 51 is situated at the second position, then the switching portion 30 transmits the rotation of the first transporting roller 60 to the second driving force transmission portion 27 and fourth driving force transmission portion 28, but does not transmit the rotation of the first transporting roller 60 to the feed driving force transmission portion 29. On the other hand, when the switch gear 51 is situated at the first position, then the switching portion 30 does not transmit the rotation of the first transporting roller 60 to the second driving force transmission portion 27 and fourth driving force transmission portion 28, but transmits the rotation of the first transporting roller 60 to the feed driving force transmission portion 29.

When attention is drawn to the point of transmitting the driving force to the fourth transporting roller 68, then the switching portion 30 with the switch gear 51 arranged at the first position is placed in a non-transmission state not to transmit the rotary driving force of the transporting motor 71 to the fourth transporting roller 68. On the other hand, the switching portion 30 with the switch gear 51 arranged at the second position is placed in a transmission state to transmit the rotary driving force of the transporting motor 71 to the fourth transporting roller 68.

In the driving force transmission mechanism 50 of the above configuration, such a state is an example of the first state of the present teaching as to reversely rotate the first transporting roller 60, second transporting roller 62 and third transporting roller 45, normally rotate the fourth transporting roller 68, and cancel the transmission of the driving force to the feeding roller 25. The first state of this embodiment (the state of the rightmost column in FIG. 8) can be realized by arranging the switch gear 51 at the second position, and driving the transporting motor 71 to rotate reversely. Further, such a state is an example of the second state of the present teaching as to normally rotate the first transporting roller 60, second transporting roller 62, third transporting roller 45 and fourth transporting roller 68, and cancel the transmission of the driving force to the feeding roller 25. The second state of this embodiment (the state of the second column from the right in FIG. 8) can be realized by arranging the switch gear 51 at the second position, and driving the transporting motor 71 to rotate normally.

Further, such a state is an example of the third state of the present teaching as to normally rotate the first transporting roller 60, second transporting roller 62 and third transporting roller 45, and cancel the transmission of the driving force to the fourth transporting roller 68 and feeding roller 25. The third state of this embodiment (the state of the leftmost column (not including the title column) in FIG. 8) can be realized by arranging the switch gear 51 at the first position, and driving the transporting motor 71 to rotate normally. Further, such a state is defined as a fourth state as to reversely rotate the first transporting roller 60, normally rotate the feeding roller 25, and cancel the transmission of the driving force to the second transporting roller 62, third transporting roller 45 and fourth transporting roller 68. The fourth state (the state of the second column from the left in FIG. 8) can be realized by arranging the switch gear 51 at the first position, and driving the transporting motor 71 to rotate reversely.

[Control Portion 30]

Figure 9:
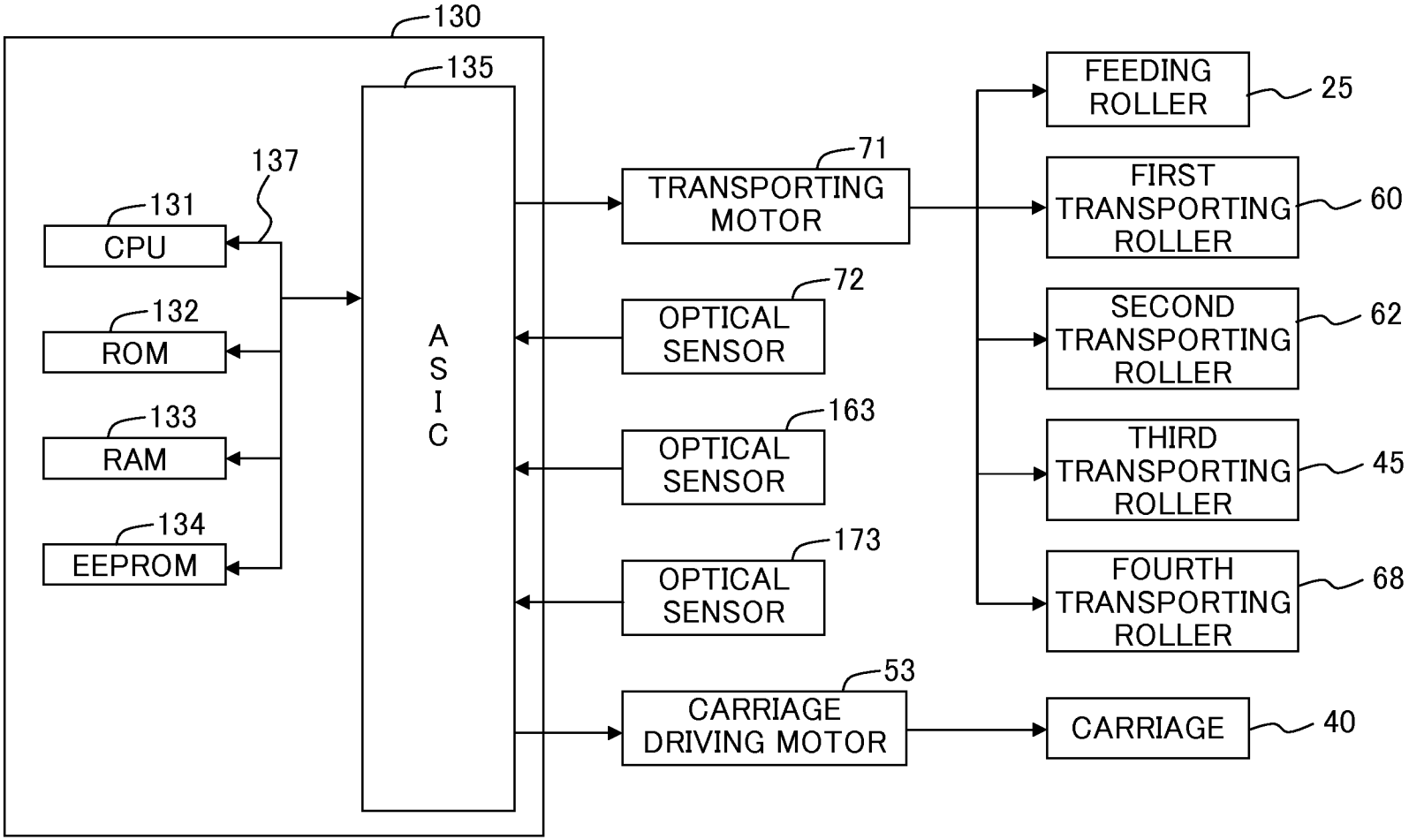
FIG. 9 is a block diagram showing a configuration of a control portion 130.

The control portion 130 shown in FIG. 9 controls the overall operation of the multifunction printer 10. For example, the control portion 130 controls the driving of the transporting motor 71 to rotate each roller. Further, the control portion 130 controls the driving of the carriage driving motor 53 to move the carriage 40. As shown in FIG. 9, the control portion 130 includes a CPU 131, a ROM 132, a RAM 133, an EEPROM 134, an ASIC 135, and an internal bus 137 connecting the above components with each other.

The ROM 132 stores programs and the like for the CPU 131 to control various operations. The RAM 133 is used as a storage area which temporarily records data, signals and the like used for the CPU 131 to execute the above programs. The EEPROM 134 stores settings, flags and the like which should still be retained even after the power is turned off.

The ASIC 135 is electrically connected with the transporting motor 71 and the carriage driving motor 53. The ASIC 135 acquires a drive signal from the CPU 131 for rotating each motor, and outputs a drive current in accordance with the drive signal to the corresponding motor. Each motor is caused to perform normal rotation driving or reverse rotation driving at a predetermined rotary speed by the drive current from the ASIC 135.

Further, the ASIC 135 is also electrically connected with the optical sensor 72 of the rotary encoder 73, the optical sensor 163 of the first sensor 160, and the optical sensor 173 of the second sensor 170. Based on a pulse signal acquired from the optical sensor 72, the control portion 130 detects the amount of each rotation of the respective transporting rollers 60, 62 and 45. Further, based on detection signals from the respective optical sensors 163 and 173, the control portion 130 detects the position of the recording paper 12.

[Control by the Control Portion 130]

Figure 10A:
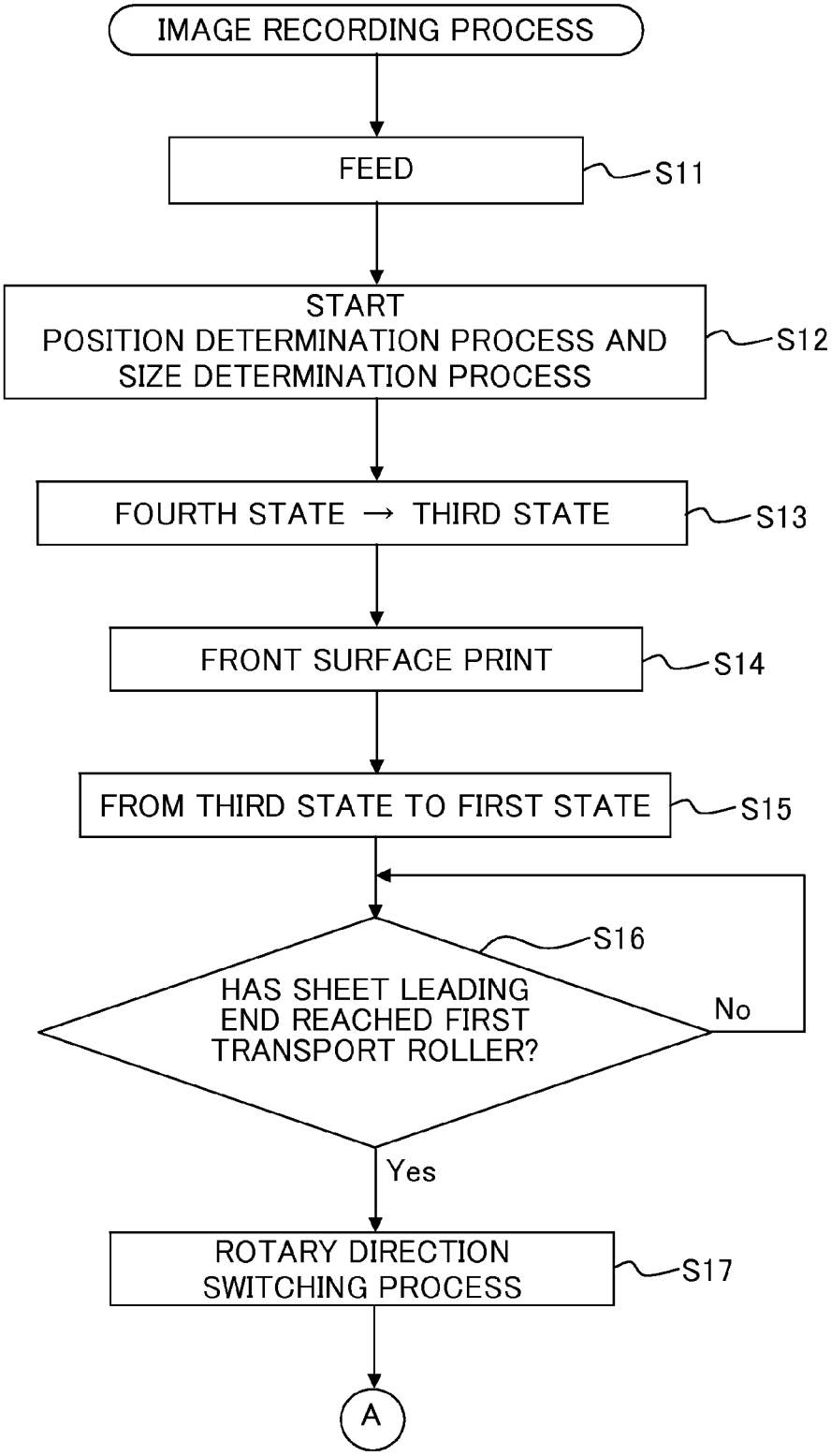
FIGS. 10A and 10B are flowcharts each showing a processing procedure carried out by the control portion 130.
Figure 10B:
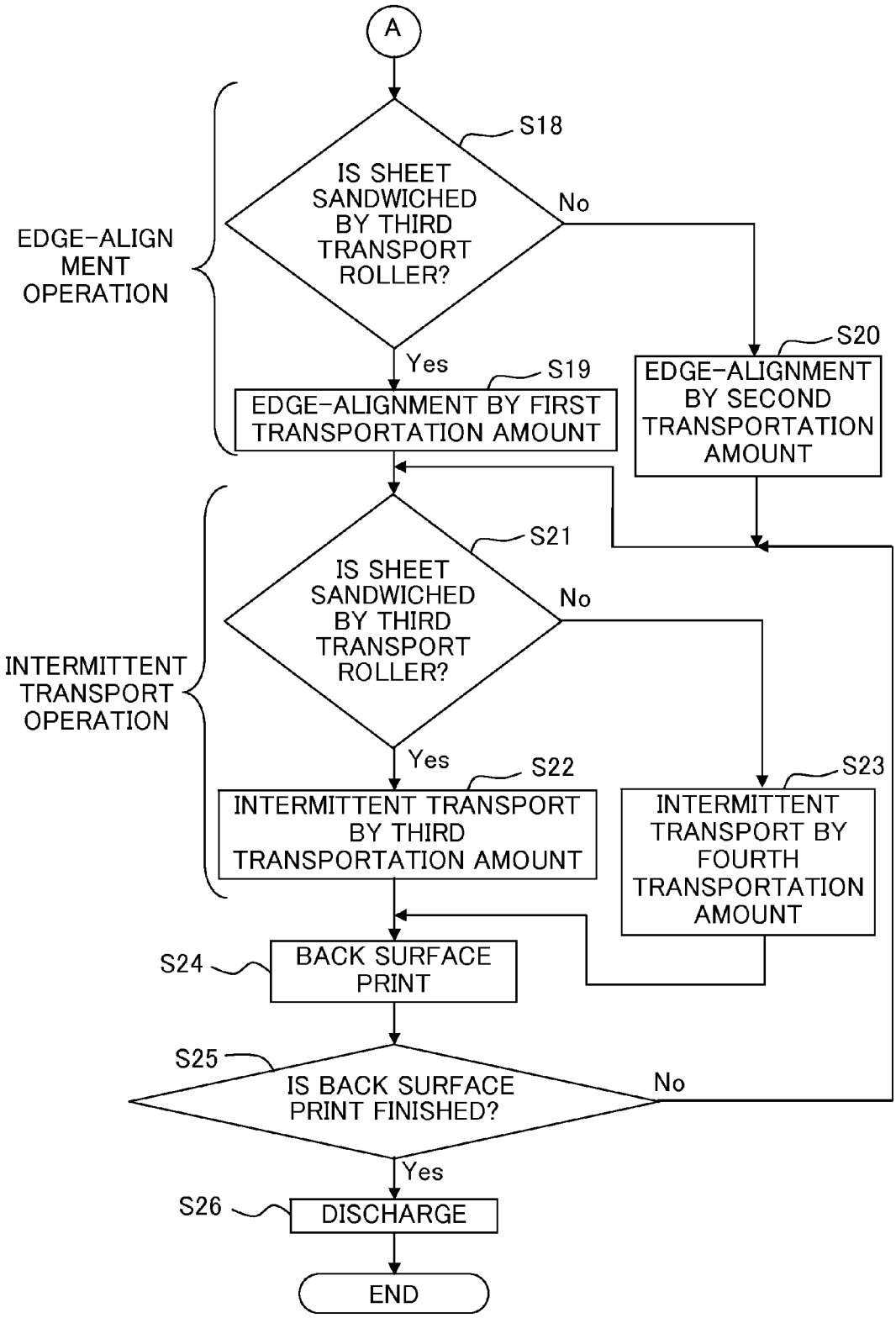

Based on the flowchart of FIG. 10, the following explanation will be made for a processing procedure to record images on both sides of a sheet of the recording paper 12. Further, the process of FIG. 10 is carried out by the control portion 130. Further, with FIG. 10, the explanation is made especially in detail for the processing procedure through which the recording paper 12 having switched back at the branch position 36 passes through the second transporting path 67, and is then sent into the first transporting path 65 again from the junction position 37.

First, when an image recording instruction is inputted to the multifunction printer 10, the control portion 130 sets the driving force transmission mechanism 50 into the fourth state. That is, the control portion 130 arranges the switch gear 51 at the first position, and drives the transporting motor 71 to rotate reversely. By virtue of this, the recording paper 12 loaded on the feeding tray 20 is sent out to the first transporting path 65 by the feeding roller 25 (step S11; to be described simply as S11 hereinbelow).

Next, on determining that the downstream end (i.e., the anterior end) of the recording paper 12 in the first transporting orientation 15 has reached the first sensor 160, the control portion 130 starts a position determination process and a size determination process (S12). Further, the fact that the anterior end of the recording paper 12 has reached the first sensor 160 is determined by the fact that the detection signal outputted from the first sensor 160 has changed from a low-level signal to a high-level signal.

In the position determination process, the control portion 130 counts the number of the pulse signals of the rotary encoder 73 (the number of the high-level signals) from the point of time when the anterior end of the recording paper 12 has reached the first sensor 160. Then, the control portion 130 determines that the anterior end of the recording paper 12 has reached the first sensor 160 at the point of time when, for example, the counted number of the pulse signals has reached a threshold value. Here, the threshold value is predetermined as a value equivalent to the distance from the first sensor 160 to the first transporting roller 60. Further, in the position determination process, by retaining in advance a plurality of threshold values respectively equivalent to the distances from the first sensor 160 to other components (for example, the third transporting roller 45, fourth transporting roller 68, and the like), it is possible to determine that the anterior end of the recording paper 12 has reached each of the other components. Further, by counting the number of the pulse signals from the point of time when the upstream end (i.e., the posterior end) of the recording paper 12 in the first transporting orientation 15 has reached the first sensor 160, it is possible to determine the position of the posterior end of the recording paper 12. The pulse signals are counted continuously until the recording paper 12 is discharged to the discharge tray 21.

Further, not only the first sensor 160 but also the second sensor 170 can be used to carry out the position determination process. That is, the control portion 130 can determine the position of the recording paper 12 by retaining in advance some threshold values respectively equivalent to the distances from the second sensor 170 to other components, counting the pulse signals of the rotary encoder 73 from the point of time when the anterior or posterior end of the recording paper 12 has passed the second sensor 170, and comparing the counted pulse signals with those threshold values. For example, it is possible to determine that the anterior end of the recording paper 12 has reached the first transporting roller 60, as well as to determine that the anterior end of the recording paper 12 has reached the print starting position facing the recording portion 24, with reference to the point of time of having reached the first sensor 160. On the other hand, it is possible to determine that the posterior end of the recording paper 12 has passed the auxiliary roller 47 of the path switching member 41, as well as to determine that the posterior end of the recording paper 12 has passed the third transporting roller 45, with reference to the point of time of having reached the second sensor 170.

Further, in the size determination process, the control portion 130 determines the size of the recording paper 12 by the number of the pulse signals from the point of time when the anterior end of the recording paper 12 has reached the first sensor 160 until the posterior end of the recording paper 12 passes the first sensor 160 (that is, the detection signal of the first sensor 160 changes from a high-level signal to a low-level signal). That is, it is understood that the larger the number of the counted pulse signals, the bigger the size of the recording paper 12. Further, in the size determination process, it is also possible either to determine the type of the recording paper 12 (A4, B5, or the like), or to determine only the length of the recording paper 12 according to the first transporting orientation 15. Further, instead of the above size determination process, it is possible to let a user input the size of the recording paper 12.

Next, on determining that the anterior end of the recording paper 12 has reached the first transporting roller 60, the control portion 130 switches the driving force transmission mechanism 50 from the fourth state to the third state (S13). That is, the control portion 130 does not cause the switch gear 51 to move from the first position, but switches the transporting motor 71 from the reverse rotation driving mode to the normal rotation driving mode. By virtue of this, the first transporting roller 60 rotates normally to transport the recording paper 12 in the first transporting orientation 15.

Then, on determining that image recording is finished with the front surface of the recording paper 12 (to be referred to below as "front surface print") (S14), and on determining that the posterior end of the recording paper 12 has passed the auxiliary roller 47 of the path switching member 41 through the position determination process using the second sensor 170, the control portion 130 switches the driving force transmission mechanism 50 from the third state to the first state (S15). That is, the control portion 130 once stops the operation of the transporting motor 71 in the normal rotation driving mode, and then sets the transporting motor 71 into the reverse rotation driving mode after causing the carriage 40 to contact with the switch lever 55 to move the switch gear 51 from the first position to the second position. By virtue of this, with the upstream end as the anterior end in the first transporting orientation 15, the recording paper 12 comes into the second transporting path 67 from the branch position 36 to be transported through the second transporting path 67 in the second transporting orientation 16.

Next, the control portion 130 determines whether or not the anterior end of the recording paper 12 transported through the second transporting path 67 has reached the first transporting roller 60 through the position determination process using the first sensor 160 (S16). When determining that the anterior end of the recording paper 12 has reached the first transporting roller 60 (S16: Yes), the control portion 130 carries out a rotary direction switching process to switch the driving force transmission mechanism 50 from the first state to the second state (S17). In particular, the control portion 130 does not cause the switch gear 51 to move from the second position, but switches the transporting motor 71 from the reverse rotation driving mode to the normal rotation driving mode. Further, by carrying out a first switching process after causing the anterior end of the recording paper 12 to contact with the first transporting roller 60 (i.e., the transporting roller pair) which rotates reversely, it is possible to correct any inclining of the recording paper 12.

Next, the control portion 130 carries out a edge-alignment operation (S18 to S20). The edge-alignment operation refers to an operation to cause the anterior end of the recording paper 12 sandwiched by the first transporting roller 60 (and pinch roller 61) to reach the print starting position which is a predetermined position facing the recording portion 24. Here, at the point of time of carrying out the rotary direction switching process (S17), the control portion 130 determines whether or not the recording paper 12 is sandwiched by the third transporting roller 45 (and spur 46), i.e., the reversal roller pair (S18). Then, according to the determination result of step S18, the control portion 130 carries out a first rotation amount changing process to change the amount of transportation in the edge-alignment operation (i.e., the amount of rotation of the transporting motor 71).

In particular, in step S18, the control portion 130 compares the size of the recording paper 12 determined in the size determination process, with a predetermined first distance equivalent to the transport distance from the third transporting roller 45 to the first transporting roller 60 via the second transporting path 67. Now, when the size of the recording paper 12 is not less than the first distance, then the control portion 130 determines that the recording paper 12 is sandwiched by the reversal roller pair at the point of time when the anterior end of the recording paper 12 has reached the first transporting roller 60 (S18: Yes). On the other hand, when the size of the recording paper 12 is less than the first distance, then the control portion 130 determines that the recording paper 12 is not sandwiched by the reversal roller pair at the point of time when the anterior end of the recording paper 12 has reached the first transporting roller 60 (S18: No).

Further, in step S18, it is also possible to prestore some data of the types (A3, B4, and the like) of the recording paper being transported through the second transporting path 67 and sandwiched simultaneously by both the transporting roller pair and the reversal roller pair, and compare those data with the type of the recording paper 12 determined in the size determination process. Then, when the size of the recording paper 12 is included in those data, then the control portion 130 determines that the recording paper 12 is sandwiched simultaneously by both the transporting roller pair and the reversal roller pair (S18: Yes). On the other hand, when the size of the recording paper 12 is not included in those data, then the control portion 130 determines that the recording paper 12 is not sandwiched simultaneously by both the transporting roller pair and the reversal roller pair (S18: No). Further, the abovementioned data may also be some data of the types of the recording paper which is not to be sandwiched simultaneously by both the transporting roller pair and the reversal roller pair.

When determining that the recording paper 12 is sandwiched by the reversal roller pair (S18: Yes), the control portion 130 causes the recording paper 12 to be transported as much as a first transportation amount in the edge-alignment operation (S19). On the other hand, when determining that the posterior and of the recording paper 12 has passed the reversal roller pair (S18: No), the control portion 130 causes the recording paper 12 to be transported as much as a second transportation amount in the edge-alignment operation (S20).

Here, when switching the rotary direction of the transporting motor 71 through the rotary direction switching process (S17), the first transporting roller 60 and third transporting roller 45 switch instantaneously from the reverse rotation to the normal rotation. On the other hand, a certain amount of time is required for the fourth transporting roller 68 to wait until the pendulum gear 111 separates from the reverse rotation engagement gear 105, and the pendulum gear 110 engages the normal rotation engagement gear 104. That is, during the time required for the second pendulum gear mechanism 103 to switch, the rotary driving force of the transporting motor 71 is not transmitted to the fourth transporting roller 68.

As a result, when the recording paper 12 is sandwiched by the reversal roller pair at the point of time of the rotary direction switching process (S17), then during the period of time for the second pendulum gear mechanism 103 to switch, pulling at the recording paper 12 against each other occurs between the transporting roller pair and the reversal roller pair. Therefore, when the first transporting roller 60 is rotated by the same amount as usual, then the recording paper 12 being sandwiched simultaneously by both the transporting roller pair and the reversal roller pair is transported in reality through a shorter distance than the case of being not sandwiched simultaneously by both of the roller pairs. Hence, the first transportation amount is set to have a larger value than the second transportation amount.

Next, the control portion 130 carries out an intermittent transport operation (S21 to S23), and a back surface print (S24). The intermittent transport operation serves to transport the recording paper 12 finished with the edge-alignment operation to the first transporting roller 60 intermittently in predetermined width units according to the first transporting orientation 15. First, the control portion 130 determines whether or not the recording paper 12 is sandwiched by the third transporting roller 45 (and spur 46), i.e., the reversal roller pair (S21). Then, according to the determination result of step S21, the control portion 130 carries out a second rotation amount changing process to change the amount of transportation in the intermittent transport operation (i.e., the amount of rotation of the transporting motor 71).

In step S21, by such a process as below, for example, it is possible to determine whether or not the recording paper 12 is sandwiched by the reversal roller pair. First, based on the paper size determined in the size determination process, the control portion 130 can calculate a second distance which is the distance required for the posterior end of the recording paper 12 to pass the third transporting roller 45 at the point of time when the anterior end of the recording paper 12 has reached the first transporting roller 60 (i.e., the point of time when "S16: Yes" is determined). Further, the control portion 130 starts to count the pulse signals of the rotary encoder 73 from the point of time when the anterior end of the recording paper 12 has reached the first transporting roller 60. Then, the control portion 130 determines that the recording paper 12 is sandwiched by the reversal roller pair until the number of the counted pulse signals reaches a value equivalent to the second distance. On the other hand, the control portion 130 determines that the posterior end of the recording paper 12 has passed the reversal roller pair, that is, the recording paper 12 is not sandwiched by the reversal roller pair, at the point of time when the number of the counted pulse signals reaches the value equivalent to the second distance.

When determining that the recording paper 12 is sandwiched by the reversal roller pair (S21: Yes), the control portion 130 causes the recording paper 12 to be transported by a third transportation amount in the intermittent transport operation (S22). On the other hand, when determining that the recording paper 12 is not sandwiched by the reversal roller pair (S21: No), the control portion 130 causes the recording paper 12 to be transported by a fourth transportation amount in the intermittent transport operation (S23). In the second state, both the transporting roller pair and the reversal roller pair rotate normally. That is, with the recording paper 12 being transported through the second transporting path 67 and sandwiched simultaneously by both the transporting roller pair and the reversal roller pair, the transporting roller pair and the reversal roller pair pull at the recording paper 12 against each other. Therefore, when the first transporting roller 60 is rotated by the same amount as usual, then the recording paper 12 being sandwiched simultaneously by both the transporting roller pair and the reversal roller pair is transported in reality through a shorter distance than the case of being not sandwiched simultaneously by both of the roller pairs. Hence, the third transportation amount is set to have a larger value than the fourth transportation amount.

Next, the control portion 130 causes the recording portion 24 to carry out image recording to the area, facing the recording head 38, of the recording paper 12 moved by the intermittent transport operation (S24). Further, in step S24, the image recording (to be referred to as "back surface print") is carried out on the back surface of the recording paper 12, i.e., the surface on the opposite side to the print surface for the front surface print.

Next, the control portion 130 determines whether or not the recording paper 12 is finished with the back surface print (S25). When the back surface print is not yet finished (S25: No), then the intermittent transport operation (S21 to S23) and back surface print (S24) are carried out. Then, when the back surface print is finished (S25: Yes), the control portion 130 sets the transporting motor 71 into the normal rotation driving mode until the posterior end of the recording paper 12 passes the third transporting roller 45 in the first transporting orientation 15, so as to discharge the recording paper 12 to the discharge tray 21 (S26). It is possible to determine whether or not the posterior end of the recording paper 12 has passed the third transporting roller 45 through the position determination process using the second sensor 170.

Effects of the Embodiment

In this embodiment, in the edge-alignment operation, the (first) transportation amount of the recording paper 12 sandwiched by the reversal roller pair is set to be larger than the (second) transportation amount of the recording paper 12 not sandwiched by the reversal roller pair. This is for correcting the variation in the distance of transporting the recording paper 12 in reality in the edge-alignment operation between the case that the transporting roller pair and the reversal roller pair pull at the recording paper 12 against each other, and the case that they do not. That is, it is possible to suppress the variation in the head-out position by carrying out the above control.

Further, according to this embodiment, in the intermittent transport operation, likewise, the (third) transportation amount of the recording paper 12 sandwiched by the reversal roller pair is set to be larger than the (fourth) transportation amount of the recording paper 12 not sandwiched by the reversal roller pair. By virtue of this, it is possible to suppress the variation in the transportation amount in the intermittent transport operation.

Modifications

Further, occurrence of the variation in the head-out position is not only caused by whether or not the recording paper 12 is sandwiched by the reversal roller pair. Hence, the control portion 130 may further carry out such a control as follows in the first rotation amount changing process. Further, the following control is applicable not only to the first rotation amount changing process but also to the second rotation amount changing process.

As one example, the control portion 130 may further carry out a temperature detection process to detect the surface temperature of the reversal roller pair (i.e., the third transporting roller 45). Then, in the first rotation amount changing process, the control portion 130 may increase the rotation amount of the transporting motor 71 more for the case that the surface temperature of the reversal roller pair is detected in the temperature detection process to be not lower than a predetermined threshold temperature than for the case that it is detected to be lower then the threshold temperature. On such occasion, the transportation amount of the recording paper 12 becomes even more than the first transportation amount.

There is such an inclination that the higher the surface temperature of the third transporting roller 45 is, the larger the slippage amount becomes in the first transporting roller 60 when pulling at the recording paper 12. Hence, by further carrying out the control as described above, it is possible to further suppress the variation in the head-out position. Further, in the temperature detection process, instead of the method of directly measuring the surface temperature of the third transporting roller 45, it is possible to measure the inner temperature of the printer portion 11, and estimate the surface temperature of the third transporting roller 45 from the measuring result.

As another example, the control portion 130 may further carry out a friction coefficient determination process to determine the friction coefficient of a sheet surface of the recording paper 12. Then, in the first rotation amount changing process, the control portion 130 may increase the rotation amount of the transporting motor 71 more for the case that the surface friction coefficient of the recording paper 12 is determined in the friction coefficient determination process to be less than a predetermined threshold value than for the case that it is determined to be not less then the threshold value. On such occasion, the transportation amount of the recording paper 12 becomes even more than the first transportation amount.

Because of pulling at the recording paper 12 against each other between the transporting roller pair and the reversal roller pair, when the recording paper 12 sticks to the inner side of the transporting path, then there is such an inclination that the slippage amount in the first transporting roller 60 becomes larger for glossy paper whose resistance is greater. Hence, by further carrying out the control as described above, it is possible to further suppress the variation in the head-out position.

Further, in the friction coefficient determination process, it is also possible to determine the surface friction coefficient of the recording paper 12 according to the type of the recording paper 12 included in the image recording instruction (that is, the type of the recording paper 12 inputted by a user). That is, when the recording paper 12 is glossy paper, then the surface friction coefficient of the recording paper 12 may be determined to be less than the threshold value, whereas when the recording paper 12 is plain paper, then the surface friction coefficient of the recording paper 12 may be determined to be not less than the threshold value.

Further, the combinations shown in FIG. 8 between the normal rotation driving mode and reverse rotation driving mode of the transporting motor 71, and the normal rotation and reverse rotation of each roller pair are an example, and hence the present teaching is not limited thereto. That is, the driving force transmission mechanism 50 may be configured in any such manner as capable of normally rotating the transporting roller pair and reversal roller pair by one of the normal rotation driving and reverse rotation driving of the transporting motor 71, reversely rotating the transporting roller pair and reversal roller pair by the other of the normal rotation driving and reverse rotation driving of the transporting motor 71, and normally rotating the re-transporting roller pair by the rotations (both the normal rotation driving and the reverse rotation driving) of the transporting motor 71.

Further, the configuration of the fourth driving force transmission portion 28 in the above embodiment is an example, and hence the present teaching is not limited thereto. For example, it may also be configured to omit the pendulum gear 111 and arm 113, and cause the pendulum gear 110 to engage the normal rotation engagement gear 104 and reverse rotation engagement gear 105. That is, the fourth driving force transmission portion 28 may be configured in any such manner as capable of transmitting the rotation of the sun gear 109 in one of the first orientation and second orientation to the driving axle of the fourth transporting roller 68 with an odd number of gears, and transmitting the rotation of the sun gear 109 in the other orientation to the driving axle of the fourth transporting roller 68 with an even number of gears.

Further, in the above embodiment, switching between the first transportation amount and the second transportation amount may also be carried out by, for example, either changing the length of time of rotating the transporting motor 71, or changing the rotation amount per unit time (i.e., the rotary speed) of the transporting motor 71. The same is true for switching between the third transportation amount and the fourth transportation amount.

What is claimed is:

1. An image recording apparatus configured to record an image on a sheet, comprising:

a main body including a first transporting path and a second transporting path formed therein, the first transporting path being a path through which the sheet is transported in a first transporting orientation, and the second transporting path being a path which branches from the first transporting path at a branch position and rejoins the first transporting path at a junction position on the upstream side to the branch position in the first transporting orientation and through which the sheet is transported in a second transporting orientation from the branch position toward the junction position;

a transporting roller pair provided at the first transporting path on the downstream side from the junction position in the first transporting orientation, and configured to rotate in a normal rotation to transport the sheet on the first transporting path in the first transporting orientation and to rotate in a reverse rotation in the opposite orientation to the normal rotation;

a recording portion provided at the first transporting path on the downstream side from the transporting roller pair in the first transporting orientation and on the upstream side to the branch position in the first transporting orientation to carry out image recording on the sheet transported by the transporting roller pair;

a reversal roller pair provided at the first transporting path on the downstream side from the branch position in the first transporting orientation, and configured to rotate in a normal rotation to transport the sheet with the images recorded by the recording portion in the first transporting orientation and to rotate in a reverse rotation to transport the upstream end of the sheet as the anterior end in the first transporting orientation to the second transporting path;

a re-transporting roller pair provided at the second transporting path, and configured to rotate in a normal rotation to transport the sheet, transported to the second transporting path by the reversal roller pair, in the second transporting orientation;

a transporting motor configured to rotate in a normal rotation and a reverse rotation;

a first transmission mechanism configured to transmit one of the normal rotation and the reverse rotation of the transporting motor to the transporting roller pair and the reversal roller pair to rotate normally, and configured to transmit the other of the normal rotation and reverse rotation of the transporting motor to the transporting roller pair and the reversal roller pair to rotate reversely;

a second transmission mechanism configured to transmit the rotations of the transporting motor to the re-transporting roller pair to rotate normally; and a controller, wherein the second transmission mechanism includes: a sun gear configured to rotate in a first orientation by the normal rotation of the transporting motor, and to rotate in a second orientation opposite to the first orientation by the reverse rotation of the transporting motor; an arm supported to be revolvable relative to the sun gear; a pendulum gear rotatably supported by the arm to engage the sun gear, configured to revolve around the sun gear in the first orientation by the rotation of the sun gear in the first orientation, and to revolve around the sun gear in the second orientation by the rotation of the sun gear in the second orientation; and a gear row including a plurality of gears engaging each other to transmit the rotation of the sun gear to a driving axle of the re-transporting roller pair by engaging the pendulum gear which has revolved in the first orientation and in the second orientation, wherein the second transmission mechanism is configured to change posture between a first posture and a second posture, the first posture being a posture to transmit the rotation of the sun gear in the first orientation to the driving axle with the pendulum gear and an odd number of gears included in the gear row, and the second posture being a posture to transmit the rotation of the sun gear in the second orientation to the driving axle with the pendulum gear and an even number of gears included in the gear row, wherein the controller is configured to perform:

determining a position of the sheet;

determining a size of the sheet;

switching the rotation of the transporting motor from one to the other between the normal rotation and the reverse rotation under a condition that it is determined that the sheet having passed through the second transporting path has reached the transporting roller pair; and increasing the rotation amount of the transporting motor more for the case that the size of the sheet is determined to be not less than a transport distance from the reversal roller pair to the transporting roller pair than for the case that it is determined to be less than the transport distance, in an edge-alignment operation to cause the anterior end of the sheet to reach a print starting position facing the recording portion.

2. The image recording apparatus according to claim 1, wherein the second transmission mechanism includes: a first gear and a second gear which engage each other in the gear row, a first arm and a second arm which constitute the arm, a first pendulum gear which is rotatably supported by the first arm and which constitutes the pendulum gear, and a second pendulum gear which is rotatably supported by the second arm and which also constitutes the pendulum gear; the first posture is such a posture that the first pendulum gear having revolved in the first orientation is engaged by the first gear, and the second pendulum gear having revolved in the first orientation is separated from the second gear; and the second posture is such a posture that the second pendulum gear having revolved in the second orientation is engaged by the second gear, and the first pendulum gear having revolved in the second orientation is separated from the first gear.

3. The image recording apparatus according to claim 1, wherein the controller is configured to perform: detecting a surface temperature of the reversal roller pair; and the controller is configured to increase the rotation amount of the transporting motor more for the case that the surface temperature of the reversal roller pair is detected to be not lower than a predetermined threshold temperature than for the case that it is detected to be lower than the threshold temperature.

4. The image recording apparatus according to claim 1, wherein the controller is configured to perform determining a surface friction coefficient of the sheet; and the controller is configured to increase the rotation amount of the transporting motor more for the case that the surface friction coefficient of the sheet is determined to be less than a predetermined threshold value than for the case that it is determined to be not less than the threshold value.

5. The image recording apparatus according to claim 4, wherein the controller is configured to determine that the surface friction coefficient of the sheet is less than the threshold value under a condition that the sheet is made of glossy paper, and the surface friction coefficient of the sheet is not less than the threshold value under a condition that the sheet is made of plain paper.

6. The image recording apparatus according to claim 1, wherein in an intermittent transport operation for the transporting roller pair to transport the sheet finished with the edge-alignment operation intermittently in predetermined width units according to the first transporting orientation, the controller is configured to increase the rotation amount of the transporting motor more for the case that the sheet is determined to be sandwiched by the reversal roller pair than for the case that it is determined to be not sandwiched by the reversal roller pair.

7. The image recording apparatus according to claim 1, further comprising:

a detecting section arranged at the first transporting path to output respective detection signals according to the presence and the absence of the sheet; and a rotary encoder arranged to output pulse signals indicating the rotation amount of the transporting motor, wherein the controller is configured to determine the position of the sheet by counting the number of the pulse signals acquired from the rotary encoder from the point of time of acquiring a first detection signal indicating that the anterior end of the sheet has reached the detection portion; and wherein the controller is configured to determine the size of the sheet by counting the number of the pulse signals acquired from the rotary encoder from the acquiring of the first detection signal until acquiring a second detection signal indicating that the posterior end of the sheet has reached the detection portion.

8. The image recording apparatus according to claim 7, wherein the detection section includes an optical sensor configured to detect optically the presence or absence of the sheet.

9. The image recording apparatus according to claim 1, wherein the first and second transmission mechanisms are configured such that the re-transporting roller pair yields a larger transportation amount per unit time than the transporting roller pair.

* * * * *